US005418607A

United States Patent [19]

Tani

[11] Patent Number: 5,418,607

[45] Date of Patent: May 23, 1995

[54] TWO SIDE RECORDING METHOD AND APPARATUS THEREFOR

[75] Inventor: Tatsuo Tani, Urayasu, Japan

[73] Assignee: Ricoh Company, Ltd., Tokyo, Japan

[21] Appl. No.: 939,310

[22] Filed: Sep. 2, 1992

[30] Foreign Application Priority Data

Sep. 3, 1991 [JP] Japan ..... 3-223178

[51] Int. Cl.[6] ..... G03G 21/00

[52] U.S. Cl. ..... 355/319; 355/26; 355/77

[58] Field of Search ..... 355/318, 308, 24, 26, 355/77, 319; 271/3.1, 4, 225

[56] References Cited

U.S. PATENT DOCUMENTS 4,330,197 5/1982 Smith et al. ..... 355/319
4,466,733 8/1984 Pels ..... 355/24 X
4,536,078 8/1985 Ziehm ..... 355/319 X
5,132,719 7/1992 Kioka et al. ..... 355/319 X

*Primary Examiner*—A. T. Grimley
*Assistant Examiner*—Shuk Y. Lee
*Attorney, Agent, or Firm*—Cooper & Dunham

[57] ABSTRACT

A method and apparatus for recording a plurality of documents each carrying an image on one side thereof on both sides of paper sheets in order of page. During the first circulation or cycle of a recirculating document handler (RDH), the second document and successive every other document are illuminated to be sequentially reproduced on one side of paper sheets. The resulting one-sided copy sheets are sequentially stacked on an intermediate tray. Whether or not the last document during the first cycle is subjected to image formation is determined to thereby determine whether the number of documents is odd (subjected to image formation) or even (not subjected to it). A particular image forming processing matching the result of decision is executed. Further, whether or not the copy sheet should be routed through a turning device before discharge is determined to stack them in order of page.

5 Claims, 21 Drawing Sheets

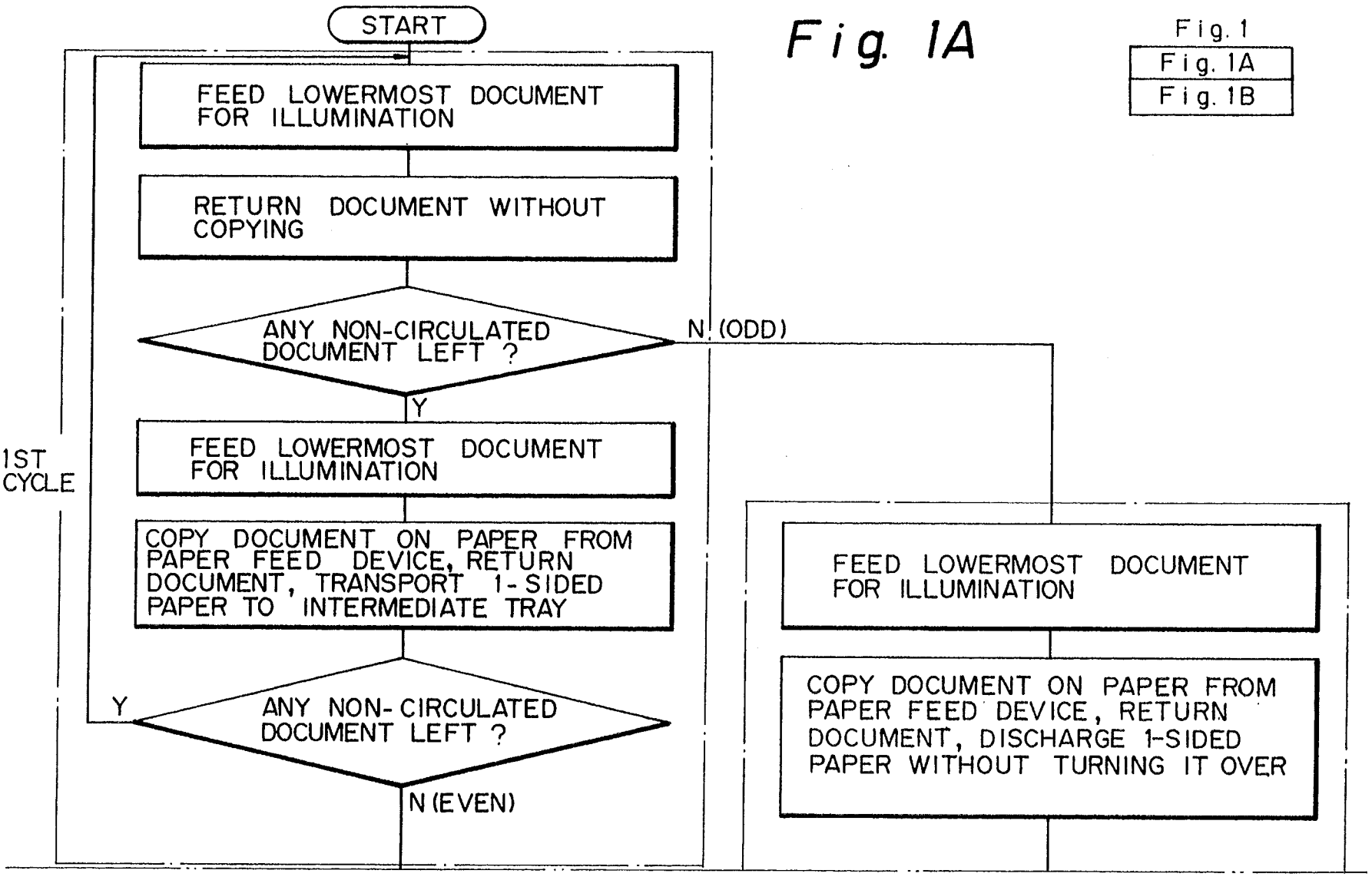
Fig. 1
Fig. 1A
Fig. 1B
Fig. 1A
START
FEED LOWERMOST DOCUMENT FOR ILLUMINATION
RETURN DOCUMENT WITHOUT COPYING
ANY NON-CIRCULATED DOCUMENT LEFT ?
Y
N (ODD)
FEED LOWERMOST DOCUMENT FOR ILLUMINATION
COPY DOCUMENT ON PAPER FROM PAPER FEED DEVICE, RETURN DOCUMENT, TRANSPORT 1-SIDED PAPER TO INTERMEDIATE TRAY
ANY NON-CIRCULATED DOCUMENT LEFT ?
Y
N (EVEN)
FEED LOWERMOST DOCUMENT FOR ILLUMINATION
COPY DOCUMENT ON PAPER FROM PAPER FEED DEVICE, RETURN DOCUMENT, DISCHARGE 1-SIDED PAPER WITHOUT TURNING IT OVER
1ST CYCLE

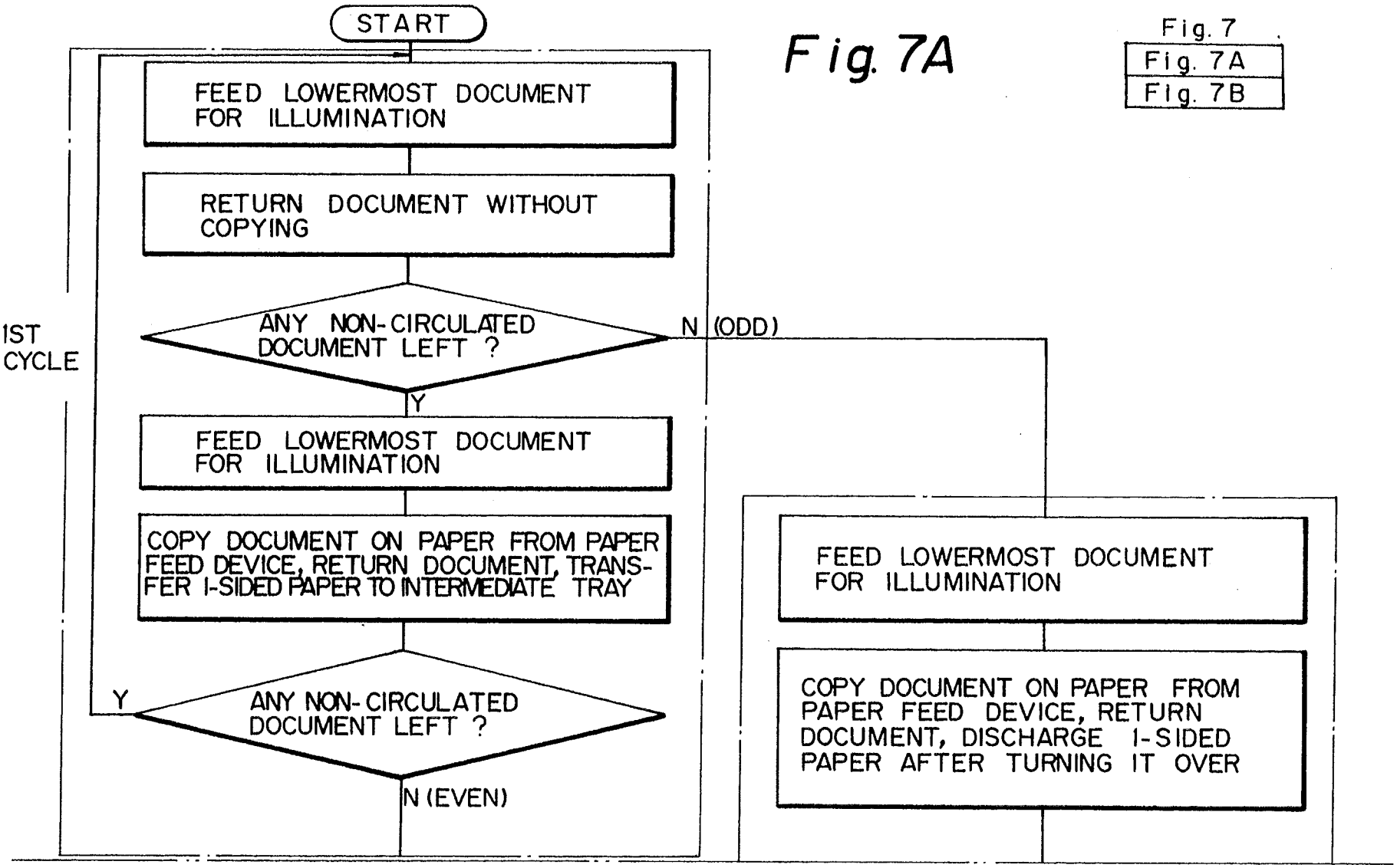
Fig. 7
Fig. 7A
Fig. 7B
Fig. 7A
START
FEED LOWERMOST DOCUMENT FOR ILLUMINATION
RETURN DOCUMENT WITHOUT COPYING
ANY NON-CIRCULATED DOCUMENT LEFT ?
N (ODD)
Y
FEED LOWERMOST DOCUMENT FOR ILLUMINATION
COPY DOCUMENT ON PAPER FROM PAPER FEED DEVICE, RETURN DOCUMENT, TRANSFER 1-SIDED PAPER TO INTERMEDIATE TRAY
ANY NON-CIRCULATED DOCUMENT LEFT ?
Y
N (EVEN)
FEED LOWERMOST DOCUMENT FOR ILLUMINATION
COPY DOCUMENT ON PAPER FROM PAPER FEED DEVICE, RETURN DOCUMENT, DISCHARGE 1-SIDED PAPER AFTER TURNING IT OVER
1ST CYCLE START
NUMBER OF SETS N SET
START BUTTON PRESSED
FEED DOCUMENT
RETURN DOCUMENT WITHOUT COPYING
END OF ONE CYCLE ?
Y (ODD)
N
FEED DOCUMENT
COPY ON FRESH PAPER AND STEER IT TO INTERMEDIATE TRAY WITHOUT RETURNING DOCUMENT (A)
END OF ONE CYCLE ?
Y(EVEN)
N
1 ST CYCLE
N = N - 1
N = N - 1

START
NUMBER OF SETS N SET
START BUTTON PRESSED
FEED DOCUMENT
RETURN DOCUMENT WITHOUT COPYING
END OF ONE CYCLE ?
Y
N
FEED DOCUMENT
COPY ON FRESH PAPER AND STEER IT TO INTERMEDIATE TRAY WITHOUT RETURNING DOCUMENT (A)
END OF ONE CYCLE ?
Y
N
N = N - 1
N = N - 1
1ST CYCLE

| |
|---|
| Fig. 10A |
| Fig. 10B |
| Fig. 10C |

START
NUMBER OF SETS N SET
START BUTTON PRESSED
FEED DOCUMENT
COPY ON FRESH PAPER AND DELIVER TO INTERMEDIATE TRAY WHILE RETURNING DOCUMENT (A)
END OF ONE CYCLE ?
Y (ODD)
N
FEED DOCUMENT
RETURN DOCUMENT WITHOUT COPYING
END OF ONE CYCLE ?
Y (EVEN)
N
1ST CYCLE
N = N - 1
N = N - 1
DISCHARGE PAPER FROM INTERMEDIATE TRAY WITHOUT FORMING IMAGE (E)

TWO SIDE RECORDING METHOD AND APPARATUS THEREFOR

BACKGROUND OF THE INVENTION

The present invention relates to a method of recording a plurality of documents each carrying an image on one side thereof on both sides of paper sheets in order of page, and an apparatus therefor.

Some modern copiers or similar image forming apparatuses are capable of recording, or copying, documents carrying images on one side thereof, i.e., one-sided documents on both sides of paper sheets in order of page. It is a common practice with this kind of image forming apparatus to use an automatic document feeder (ADF) for automatically transporting documents one by one to an illuminating section. In many cases, the last page of one-sided documents is copied first, and the first page is copied last. The problem with such a conventional two-sided copy mode is that when the number of documents is odd, the resulting copy sheet produced last and carrying the first page thereon has the other side or rear thereof left blank. Specifically, considering one set of copies, the first page (cover) or the rear thereof is left blank. To eliminate this problem, the operator may count the documents before setting them on the ADF and then input the number and odd/even information on the copier, so that the blank side may be automatically brought to the end of the set of copies. This kind of procedure, however, assigns the troublesome counting operation to the operator and, therefore, not only needs an extra period of time but also often invites miscount.

In the light of the above, before a copying operation, the ADF may be operated to circulate all the copies once to thereby automatically count them, as disclosed in, for example, Japanese Patent Publication No. 10943/1991. In this case, the above-stated control is selectively effected after the start of a copying operation, depending on whether the number of documents is odd or even. This method, however, requires the wasteful circulation of documents which does not contribute to the copying operation at all, resulting in time losses and, therefore, in inefficient copying. Moreover, the extra circulation of documents aggravates the possibility of jam, damage and contamination of the documents while accelerating the wear of constituent parts of the copier.

To omit the wasteful circulation of documents, the first page to the last page of documents may be subjected to two-sided copying in this order, as taught in, for example, Japanese Patent Publication No. 10620/1985 and Japanese Patent Laid-Open Publication No. 18743/1979. Then, whether the number of documents is odd or even should only be determined when the copying operation is proceeded to the last page. When the number of documents is odd, the paper sheet carrying the last page on one side thereof is discharged upside down without an image formed on the other side thereof. As a result, a set of two-sided copies is completed in order of page. However, this kind of procedure has various problems left unsolved when applied to a copier of the type advantageously operable with a finisher, e.g., a stapler or a puncher, i.e., a copier capable of finishing copies in sets, as will be discussed in detail later.

SUMMARY OF THE INVENTION

It is therefore an object of the present invention to provide a two-side recording method capable of recording a plurality of one-sided documents on both sides of paper sheets in order of page without resorting to the wasteful circulation of documents which would aggravate the probability of jam, scratch and damage to the documents, accelerate the wear of constituent parts, and lower copying efficiency, and an apparatus for practicing such a method.

It is another object of the present invention to provide a two-side recording method capable of automatically determining whether the number of documents is odd or even without resorting to a sensor responsive to the passage of a document, counter and a memory and, therefore, cutting down the cost, and an apparatus therefor.

In accordance with the present invention, a method of recording a plurality of documents each carrying an image on one side thereof to both sides of paper sheets in order of page by using a two-side recording apparatus comprising an image forming device for forming an image of a document on a paper sheet, a paper feeding device for feeding paper sheets to an image forming region of the image forming device one by one, an intermediate tray for temporarily stacking one-sided paper sheets each carrying an image on one side thereof, a refeeding device for sequentially refeeding the lowermost and successive one-sided paper sheets stacked on the intermediate tray to the image forming region such that an image is formed on the other side of each of the one-sided paper sheets, a discharging device for discharging the paper sheets undergone image formation, a turning device for turning over the paper sheets undergone image formation before the paper sheet is discharged, an illuminating section for illuminating the documents for exposure, an RDH for sequentially feeding a stack of documents, the last page first, to the illuminating section and returning the documents to the stack in the same order of page as the initial order, and a control device for controlling operations of the devices, comprises the steps of illuminating, during the first cycle of documents feed effected by the RDH, the second document and successive every other document and feeding the paper sheets from the paper feeding device to the image forming region to thereby reproduces the second document and seccessive every other document on one-side of the paper sheets, while stacking resulting one-sided copy sheets on the intermediate tray, when the last document during the first cycle is subjected to image formation, illuminating, during the second cycle, the first document and successive every other document and sequentially refeeding the one-sided copy sheets to the image forming region to produce the first document and seccessive every other document on the other side of the one-sided copy sheets, while discharging resulting two-sided copy sheets with or without the intermediary of the turning device such that the side of each of the two-sided copy sheets formed first faces upward, and when the last document during the first cycle is not subjected to image formation, illuminating, during the second cycle, the first document, feeding a paper sheet from the paper feeding device to the image forming region to reproduce the first document on one side of the paper sheet, illuminating the third document and successive every other document, sequentially refeeding the one-sided copy sheets from the intermediate tray to the image forming region to reproduce the third document and successive every other document on the other side of the one-sided copy sheets, and discharging all the copy sheets with or without the intermediary of the turning device such that the side all the copy sheets formed first faces upward.

Also, in accordance with the present invention, a two-side recording apparatus comprises an image forming device for forming an image of a document on a paper sheet, a paper feeding device for feeding paper sheets to an image forming region of the image forming device one by one, an intermediate tray for temporarily stacking one-sided paper sheets each carrying an image on one side thereof, a refeeding device for sequentially refeeding the lowermost and seccessive one-sided paper sheets stacked on the intermediate tray to the image forming region such that an image is formed on the other side of each of the one-sided paper sheets, a discharging device for discharging the paper sheets undergone image formation, a turning device for turning over the paper sheets undergone image formation before the paper sheet is discharged, a first guide member for selectively guiding a paper sheet toward the discharging device or toward the intermediate, a second guide member for selectively guiding a paper sheet to a path including the turning device or to a path not including the turning device, an illuminating section for illuminating the documents for exposure, an RDH for sequentially feeding a stack of documents, the last page first, to the illuminating section and returning the docuents to the stack in the same order of page as the initial order, a separating member or separating documents having not been fed from documents having been returned by the RDH within a single stack, an end-of-feed detecting device for determining that the documents having not been fed and positioned at one side of the separating member have been fully fed, and a control device for controlling operations of the devices. The control device comprises (a) means for subjecting, during the first cycle of the RDH for circulating a plurality of documents each carrying an image on one side thereof, only the second document and successive every other document to reproduce the second document and successive every other document on one side of paper sheets fed from the paper feeding device to the image forming region, and sequentially stacking resulting one-sided copy sheets on the intermediate tray by guiding the copy sheets by the first guide member, (b) determining means for determining, when the end-of-feed detecting device determines that the last document has been fed during the first cycle, whether or not the last document is to be subjected to image formation, and (c) means for, if the last document is to be subjected to image formation, subjecting, during the last cycle, only the first document and successive every other document to image formation to sequentially reproduce the first document and successive every other document on the other side of one-sided copy sheets refed in the same order as the copy sheets have been stacked, and discharging resulting two-sided copy sheets such that the side of the two-sided copy sheets formed first faces upward by actuating the second guide member. The means (c) subjects, if the last document is not to be subjected to image formation, the first document to image formation during the last cycle to thereby reproduce the first document on one side of a paper sheet fed from the paper feeding device, subjecting, among the second and successive documents, only the third document and successive every other document to image formation to sequentially reproduce the third document and successive every other document on the other side of one-sided copy sheets refed from the intermediate tray in the same order as the copy sheets have been stacked, and discharging all the copy sheets such that the side of the copy sheets formed later faces upward by actuating the second guide member.

BRIEF DESCRIPTION OF THE DRAWINGS

The above and other objects, features and advantages of the present invention will become more apparent from the following detailed description taken with the accompanying drawings in which:

FIGS. 1A, and 1B are flowcharts representative of one embodiment of the present invention which produces one set of two-sided copies of a plurality of one-sided documents;

FIGS. 7A, and 7B are flowcharts representative of all embodiment of the present invention which produces one set of two-sided copies of a plurality of one-sided documents by use of the copier of FIGS. 3 and 5;

DESCRIPTION OF PREFERRED EMBODIMENTS

To better understand the present invention, a brief reference will be made to the conventional schemes of the kind disclosed in previously mentioned Japanese Patent Publication No. 10620/1985 and Japanese Patent Laid-Open Publication No. 18743/1979, shown in FIGS. 12A–12D.

Figure 12A:
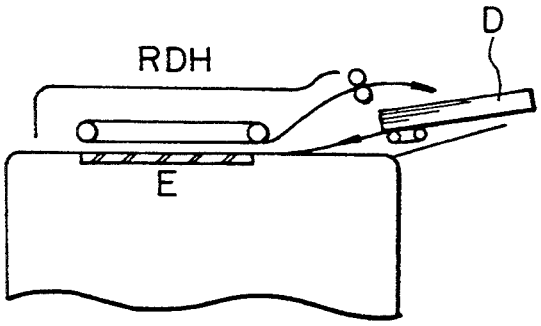
Fig. 12A PRIOR ART
FIGS. 12A, 12B, 12C, and 12D each shows a conventional two-side recording apparatus with an RDH, and a two-side recording method available therewith.
Figure 12B:
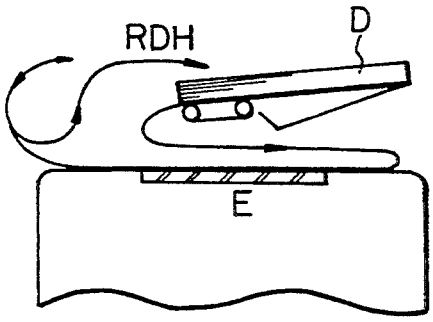
Fig. 12B PRIOR ART
Figure 12C:
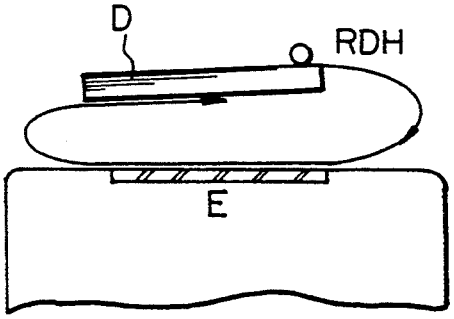
Fig. 12C PRIOR ART

FIG. 12A shows an RDH of the type feeding documents D stacked face down to an illuminating position E in order of page and returning each document undergone illumination to above the documents D by switching it back. This type of RDH, therefore, needs a substantial interval between successive document. When such an RDH is applied to a recirculation type copier which copies documents while sequentially replacing them, the copying speed and, therefore, efficiency is low or the document feed speed is extremely high. The extremely high document feed speed is apt to cause jams, smears, scratches and other undesirable occurrences while accelerating the wear of the constituent parts of the RDH. FIG. 12B shows an RDH capable of feeding documents, the first page first, while reducing the interval between successive documents. Although the RDH with such a capability enhances efficiency by reducing the interval between documents, it needs a complicated and long transport path. As a result, the entire RDH is bulky and expensive and aggravates the probability of jam. FIG. 12C shows an RDH capable of feeding documents, the first page first, at short intervals and, in addition, having a single transport path. In this type of RDH, documents are stacked face up and sequentially fed from the first page to the last page. The problem with such an RDH is that each document has to be returned to below a stack loaded on a tray section, preventing the documents from being reliably returned and stacked when the documents are curled or thin or when humidity is high.

Figure 12D:
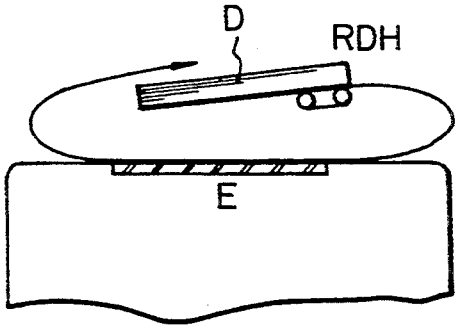
Fig. 12D PRIOR ART

In the light of the above, Japanese Patent Laid-Open Publication 26860/1982 proposes a copier using an RDH which feeds a document of the last page first, has a simple transport path, and reduces the interval between successive documents. This kind of copier makes it needless to count documents before a copying operation. Specifically, while the RDH circulates documents for the first time, the copier copies every other document i.e., the first document, third document, fifth document and so on, the last page first, and stacks the resulting one-sided copy sheets on an intermediate tray. Assume that the number of documents is odd as determined by the first circulation or first cycle. Then, before the second cycle, only one of the one-sided copy sheets is refed from the intermediate tray to an image forming station and driven out of the copier without an image formed thereon. Subsequently, the second cycle is started to sequentially reproduce the remaining documents on the other side of the one-sided copy sheets refed from the intermediate tray. Whether or not to turn over the copy sheet before driving it out of the copier is determined depending on the number of documents, i.e., odd or even. As shown in FIG. 12D, this type of RDH has a simple document transport path, reduces the interval between documents being fed, and has only to return the document undergone illumination to above the documents D stacked on a tray section. With such an RDH, therefore, it is possible to eliminate most of the problems stated earlier.

However, even with the above procedure, it is necessary to discharge, when the number of documents is odd, only one one-sided copy sheet from the intermediate tray to the outside of the copier via the image forming station before the second circulation or cycle of documents. Simply transporting this copy sheet without forming an image thereon aggravates the probability of jam, scratch and smear (background) of copy sheet and further accelerates the wear of the parts contituting the copier. Moreover, since the copying operation is interrupted between the first and second cycles, the two-sided copying efficiency is lowered. In addition, whether the number of documents is odd or even cannot be determined unless a sensor responsive to documents is located on a document circulation path and a counter for counting the outputs of the sensor and a memory for storing the count are provided, resulting in a complicated and expensive construction.

Figure 2:
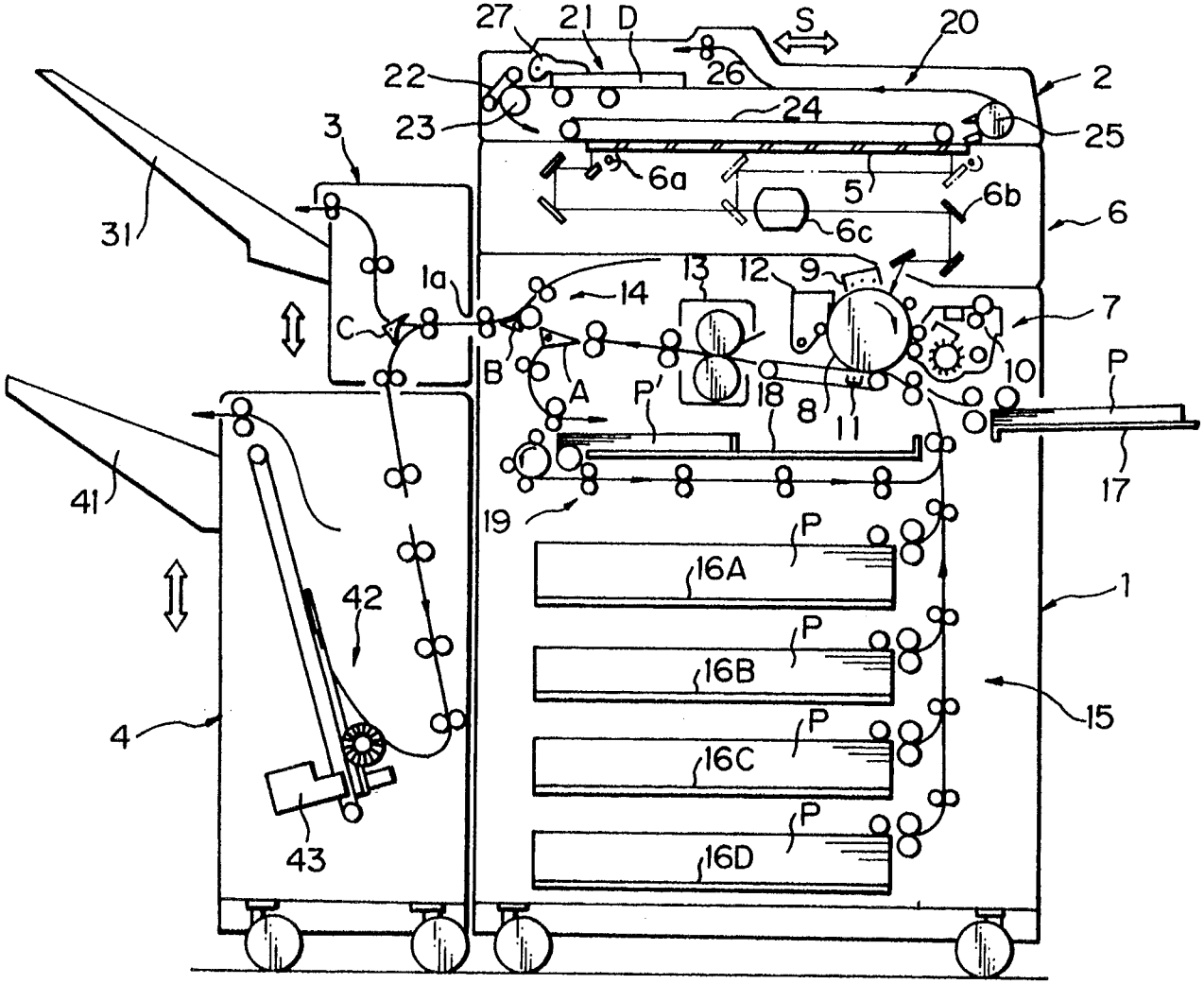
FIG. 2 shows a copier which is a specific form of a two-side recording apparatus for practicing the method of the present invention and of the type forming an image on the upper side of a paper sheet.

Referring to FIG. 2, a two-side recording apparatus for practicing the method of the present invention is shown and implemented as a copier by way of example. As shown, the copier is generally made up of a copier body 1, an RDH 2 mounted on the copier body 1, and a discharge unit 3 and a finisher 4 connected to the sheet discharge side of the copier body 1. A glass platen, or illuminating section, 5 is mounted on the top of the copier body 1. Scanning optics 6 is disposed below the glass platen 5 and includes a light source 6*a*, mirrors 6*b*, and a lens 6*c*. An image forming device 7 is located below the optics 6 and includes a photoconductive element in the form of a drum 8, a main charger 9, a developing unit 10, a transfer charger 11, a cleaning unit 12, and a fixing unit 13. A switch-back type turning device 14 turns over a copy sheet carrying an image before the copy sheet is driven out of the copier body 1. A paper feed device 15 includes four paper cassettes 16A–16D positioned one above another and a manual paper tray 17 and selectively feeds paper sheets from one of the cassettes 16A–16D and tray 17 to an image forming region defined in the image forming device 7 by rollers including a pick-up roller. Paper sheets each carrying an image on one side thereof, i.e., one-sided copy sheets are sequentially stacked on an intermediate tray 18. A refeeding device 19 is associated with the intermediate tray 18 for refeeding the one-sided copy sheets toward the image forming region in the same order as the copy sheets have been stacked, so that an image may be formed on the other side of each copy sheet.

In FIG. 2, solid lines with arrows are indicative of the path along which the paper sheets are transported. Path selectors in the form of pawls A and B are rotatably disposed in the copier body 1 and in close proximity to an outlet 1*a* formed through the copier body 1. The path selector A plays the role of a first guide member for selectively guiding the paper sheet toward the discharge unit 3 or toward the intermediate tray 18. The path selector A plays the role of a second guide member for selectively guiding the paper sheet toward a path including the turning device 14 or toward a path not including it. A main motor for driving the drum 8 and a number of feed rollers and transport rollers, cooling fan, fan motor, solenoids, clutches, sensors, power source device and control device are not shown in the figure.

The RDH 2 per ce is conventional and will be outlined hereinafter. A number of documents D are stacked on a document setting portion, or simply setting portion, 21 included in the RDH 2. The documents D are sequentially fed, the lowermost one being first, to the glass platen 5 by a feed roller 22, a transport roller 23, a belt 24 and so forth included in a document recirculating device 20, as indicated by a solid line with arrows. The document undergone illumination is driven out by the belt 24 in the same direction and then transported by a turn roller 25 and a discharge roller 26 to be returned to the top of the document stack D. The discharge roller 26 is movable in a direction indicated by an arrow S in matching relation to the paper size.

Figure 4:
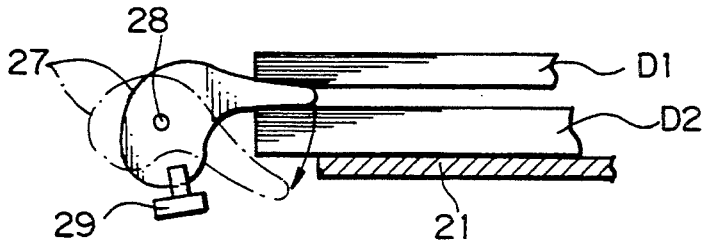
FIG. 4 is a fragmentary enlarged view showing a specific construction of a detecting device for detecting the end of document feed incorporated in an RDH shown in each of FIGS. 2 and 3.

As best shown in FIG. 4, a separating member 27 is located in the vicinity of the document setting portion 21 of the RDH 2 and rotatably mounted on a shaft 28. The free end of the separating member 27 rests on the top of the document stack D set on the setting portion 21. As the lowermost document is fed out of the stack D and then returned to the setting portion 21, it lies on the separating member 27, as illustrated. Hence, the documents circulated (D2, FIG. 4) are separated from the documents not circulated (D1, FIG. 4) by the separating member 27. When all the documents D1 are circulated, the separating member 27 rotates to a position indicated by a phantom line in FIG. 4 due to gravity or, for example, the bias of a spring. As a photosensor or similar sensor 29 senses such a rotation of the separating member 27, it is determined that all the documents D1 underlying the member 27 have been fed out. In this sense, the separating member 27 and sensor 29 cooperate as a device for detecting the end of document feed. When a plurality of sets of copies are desired, the separating member 27 will be rotated clockwise (FIG. 4) to rest on the document stack D again.

Referring again to FIG. 2, the discharge unit 3 has an elevatable copy tray 31 at the outside thereof. Disposed in the discharge unit 3 are a number of transport roller pairs for transporting paper sheets, and a path selector or pawl C for selectively steering a paper sheet toward the copy tray 31 or toward the finisher 4. The finisher 4 has an elevatable copy tray 41 at the outside and a number of transport roller pairs and, in the illustrative embodiment, a paper positioning device 42 and a stapler 43 at the inside.

The copier is of the type forming an image on the side of a paper sheet facing upward. A copying procedure particular to this type of copier will be outlined hereinafter.

When the RDH 2 transports one document from the document stack D to the glass platen 5, the illuminating device 6 illuminates the document. The resulting reflection from the document is projected onto the drum 8 of the image forming device 7 (exposing step). As a result, a latent image is electrostatically formed on the drum 8 having been uniformly charged by the main charger 9. The developing unit 10 develops the latent image by a toner to produce a toner image. The toner image is transferred to the upper side of a paper sheet P fed from one of the paper trays 16A–16D and manual paper trays 17 to the image forming region where the transfer charger 11 is located or the upper side of a one-sided copy sheet P' fed from the intermediate tray 18 to the same station. The paper sheet carrying the toner image is transported to the fixing unit 13 to have the toner image fixed thereon and is then driven out to the discharge unit 3. In a two-sided copy mode, the one-sided copy sheet is steered downward to the intermediate tray 18 by the path selector A and stacked thereon face down. The one-sided copy sheets P' stacked on the intermediate tray 18 are refed upward by the refeeding device 19, the lowermost sheet being first, in the same order as they have been stacked. As a result, an image is transferred or formed on the other side of each copy sheet P' facing upward. The resulting two-sided copy sheet is driven out of the copier body 1 either directly or after being turned over by the switch-back path of the turning device 14, depending on the position of the path selector B. The two-sided copy sheets are sequentially stacked on the copy tray 31 of the discharge unit 3 in order of page. When the path selector C of the discharge unit 3 is so positioned as to steer copy sheets into the finisher 4, the paper positioning device 4 will neatly stack a set of copy sheets in order of page to allow the stapler 43 to staple them.

Figure 3:
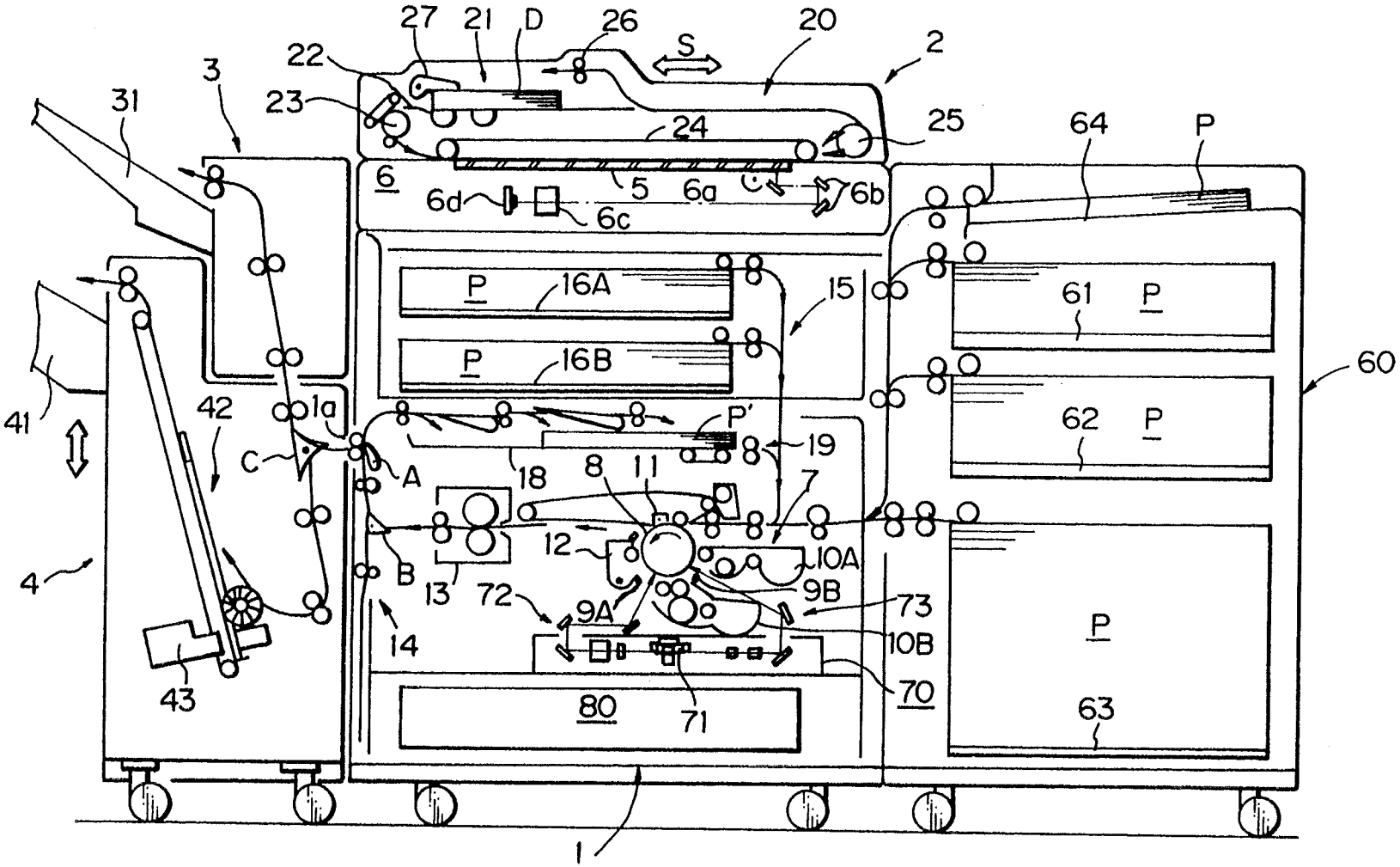
FIG. 3 is a view similar to FIG. 2, showing a copier of the type forming an image on the lower side of a paper sheet.

A reference will be made to FIG. 3 for describing a copier constructed and arranged to form an image on the side of a paper sheet facing downward. The copier of FIG. 3 is a digital copier, and the same or similar constituent parts to those shown in FIG. 2 are designated by like reference numerals. As shown, the copier body 1 has the paper feed device 15 located below the illuminating device or reading device 6 and provided with two paper cassettes 16A and 16B, and the intermediate tray 18. A control device 80 is disposed below the paper feeding device 15 in addition to the image forming device 70 and turning device 14.

The illuminating device 6 scans the lower side of a document transported to the glass platen 5 by the RDH 2 with light. A CCD (Charge Coupled Device) image sensor or similar solid-state image sensor **6*d* reads the resulting reflection from the document. The image data from the image sensor 6*d* is temporarily written to a memory, not shown, included in the control device 80. On the other hand, the image forming device 7 includes optics 70 having a semiconductor laser, a polygonal mirror 71, and two writing sections 72 and 73 each being provided with a lens and mirrors. The image data stored in the memory are subjected to various kinds of processing to produce corresponding video data. The optics 70 modulates a laser beam by the video data and illuminates the drum 8**, which is rotating as indicated by an arrow, from below with the modulated laser beam to thereby form an electrostatic latent image thereon.

With this example, it is possible to record an image in two colors, e.g., black and red. Specifically, two laser beams issuing from the two writing sections 72 and 73 write images while two developing units 10A and 10B each develops associated one of the images. A paper sheet is fed to an image forming region above the drum 8 (image transfer region where the transfer charger 11 is located) from any one of the paper feeding device 15 and intermediate tray 18 incorporated in the copier body 1, paper trays 61, 62 and 63 incorporated in a large-sized paper feeding device 60 (63 being a mass paper feed tray), and a manual paper tray 64. A toner image is transferred from the drum 8 to the lower side of the paper sheet.

One-sided copy sheets are stacked on the intermediate tray 18 face down via the switch-back path of the turning device 14 by the path selector B. The refeeding device 19 sequentially refeeds the one-sided copy sheets, the lowermost one first, to the image forming region by turning them downward. As a result, images are formed on the other side or lower side of each of such copy sheets. The one-sided or two-sided copy sheets are or are not routed through the turning device 14 depending on the position of the path selector B and then guided by the path selector A into the finisher 4. In this example, the path selector C disposed in the finisher 4 determines whether to discharge the copy sheets to the copy tray 31 via the discharge unit 3 or to discharge them to the tray 41 in successive sets positioned by the positioning device 42 and stapled by the stapler 43.

It is to be noted that the image forming device 7 shown in FIGS. 2 and 3 is not limited to the above-described types and may be replaced with a type transferring an electrostatic latent image to a paper sheet and then developing it or a type forming an image directly on a paper sheet (e.g. thermosensitive recording, thermal transfer recording or wire dot recording).

Figure 5:
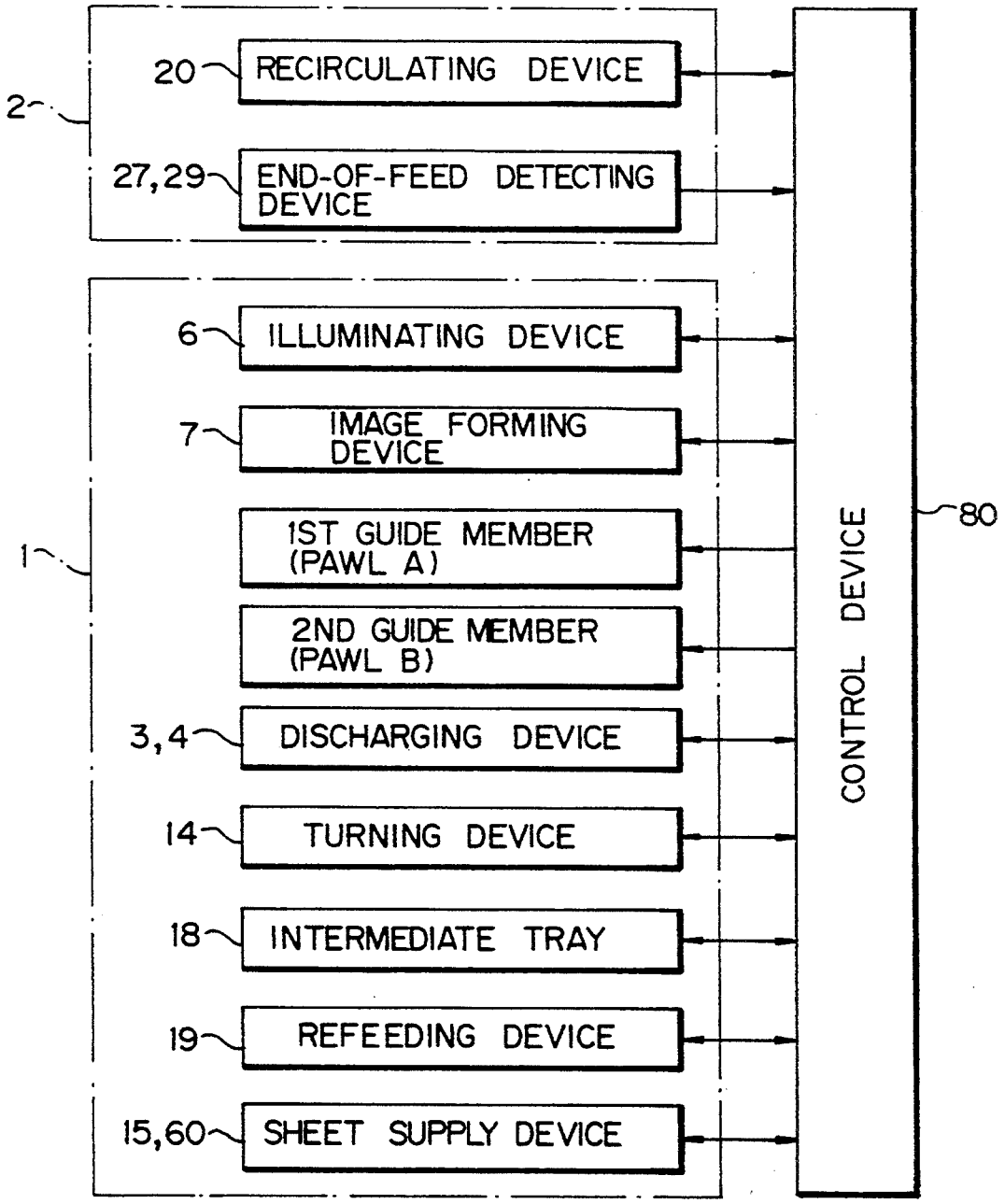
FIG. 5 is a block diagram schematically showing a relation between various sections of the copier shown in FIG. 2 or 3 and a control device.

FIG. 5 is a block diagram schematically showing a relation between the various portions constituting each of the copiers described above and the control device. In FIG. 5, the same reference numerals as those shown in FIGS. 2 and 3 designate corresponding portions. The control device 80 is implemented by a microcomputer for executing the sequence control of the entire copier (including the control in the two-sided copy mode particular to the invention), error check, and various kinds of decision (as well as the write-in and read-out of image data and various kinds of processing in the case of the digital copier shown in FIG. 3), an input/output circuit, drivers, etc. The control device 80 is bodily accommodated in the copier body 1 or partly accommodated in the copier body 1 and partly in the RDH 2.

Figure 6:
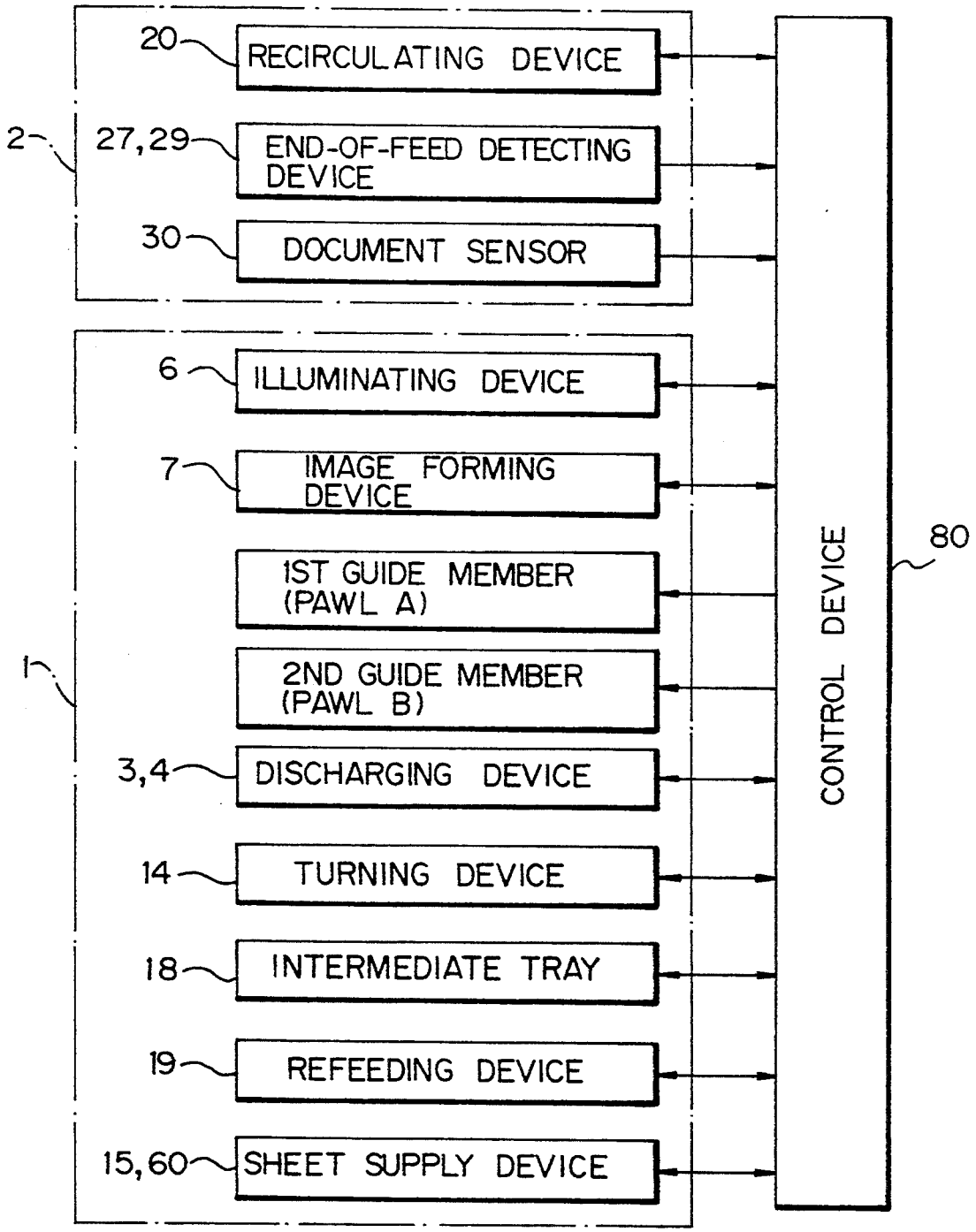
FIG. 6 is a block diagram similar to FIG. 5, showing another specific relation.

FIG. 6 is a block diagram similar to FIG. 5 except that a document sensor 30, e.g., a reflection type or transmission type photosensor or a microswitch is provided for sensing the passage of a document being transported along the document recirculation path of the RDH 2. In this case, the control device 80 has a counting function for counting documents in terms of the outputs of the document sensor 30, and a memory for storing the count.

A reference will be made to FIGS. 1–7 for describing two-sided copying procedures available with the copiers stated above.

To begin with, assume that the copier of FIG. 2 which forms an image on the upper side of a paper sheet is operated to produce one set of two-sided copies of a plurality of one-sided documents. Then, the control device 80 shown in FIG. 5 executes a specific procedure shown in FIG. 1.

In this case, the documents are stacked on the document setting portion 21 of the RDH 2 face up in order of page, the first page on the top. Since the documents D are copied every other page while being circulated, they are circulated twice to produce one full set of copies. On the start of the routine shown in FIG. 1, the RDH 2 feeds the lowermost document, i.e., document of the last page and transports it to the illuminating position on the glass platen 5. However, this document is simply returned to the setting portion 21 without being copied. Specifically, this document is turned over such that its image faces upward, and then stacked on the uppermost document, i.e., the document of the first page of the stack D with the intermediary of the separating member 27.

Subsequently, the control device 80 determines whether or not any documents are left on the setting portion 21 without being circulated. Assuming that the sensor shown in FIG. 4 is a transmission type photosensor, its output will be in an OFF state if the separating member 27 rests on the non-circulated documents D1 while interrupting the optical path of the sensor. This indicates that non-circulated documents are present on the setting portion 21. Since such documents are, of course, present on the setting portion 21 at first, the result of decision by the control device 80 is positive. Then, the control device 80 causes the RDH 2 to feed the lowermost document again, i.e., the document of the second page from the last this time. As this document reaches the illuminating position, it is reproduced on one side of a paper sheet fed from the paper feeding device 15. Thereafter, the document is returned to the setting portion 21 while the one-sided copy sheet is steered to the intermediate tray 18 by the path selector A and stacked thereon face down. The control device 80 again determines whether or not non-circulated documents are present and, if they are present, repeats the above procedure with every other document until all the documents have been circulated once. Assume that the output of the sensor has changed to an ON state, i.e., the control device has determined that non-circulated documents are absent. Then, if the last document or first page of document fed at that time is copied, meaning that the number of documents is even, the control device 80 executes the procedure shown at the left-hand side of 2ND CYCLE, FIG. 1. If the above-mentioned document is not copied, meaning that the number of documents is odd, the control device 80 executes the procedure shown at the right-hand side of 2ND CYCLE.

Figure 1B:
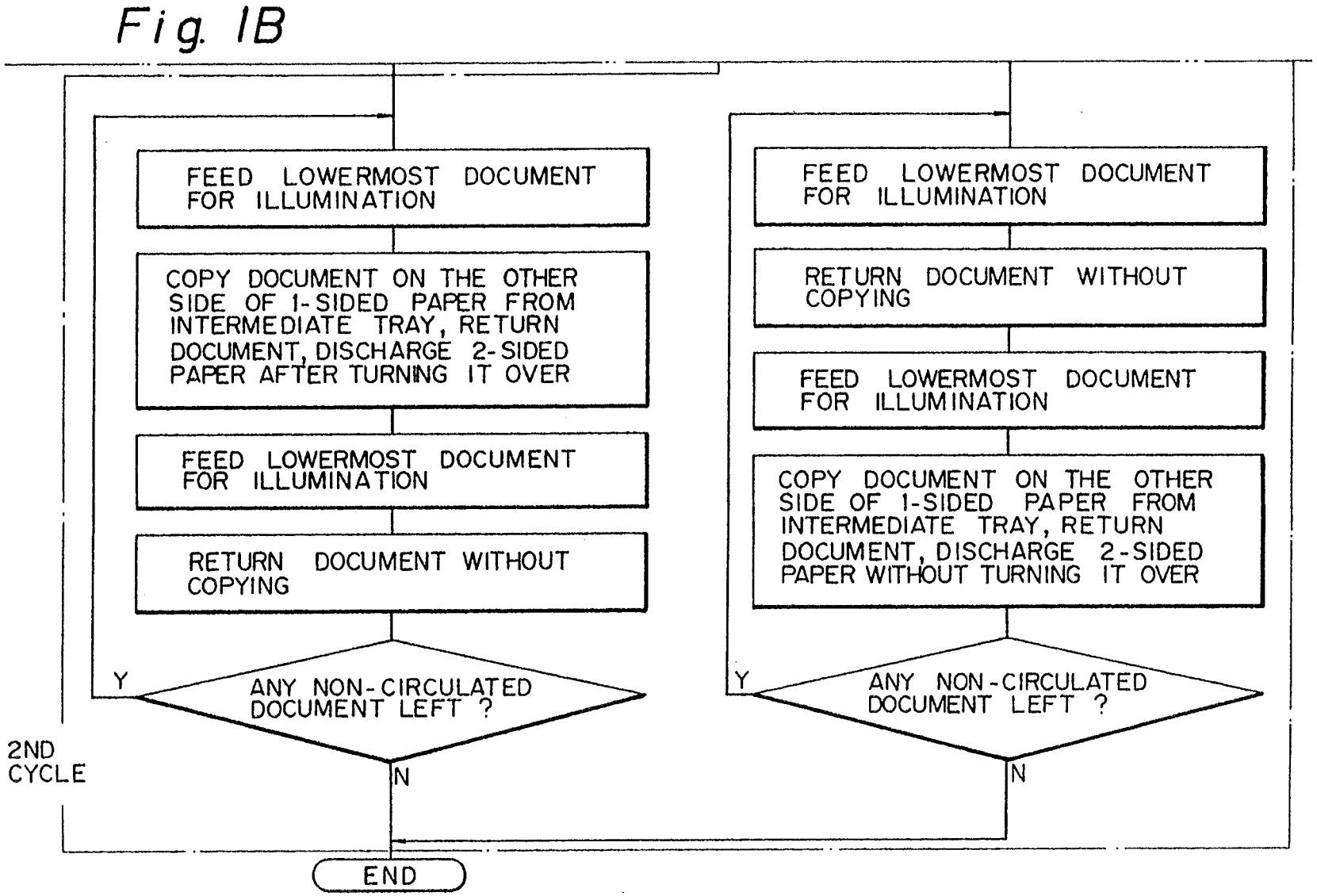

To determine whether the number of documents is odd or even, the document sensor 30, FIG. 6, may be provided on the transport path of the RDH 2 to allow the control device 80 to count the documents in terms of the outputs of the sensor 30. However, the procedure shown in FIG. 1 is simpler and more reliable. If the number of documents is odd, i.e., if the document fed last is copied, the control device 80 determines that all the odd pages of the documents have been copied by the first cycle. Then, as the lowermost document or last page of document is fed for the second cycle, the first copy sheet or lowermost copy sheet carrying the image of the second document from the last on one side thereof is refed from the intermediate tray 18 to form an image on the other side. Subsequently, the document is returned to the setting portion 21 while the resulting two-sided copy sheet is driven into the discharge unit 3 via the switch-back path of the turning device 14 by the path selector B, i.e., in such a position that the side where the image was formed first faces upward. If the path selector C is so positioned as to select the discharge unit 3, the copy sheet is discharged to the copy tray 31; if it is positioned to select the finisher 4, the copy sheet is discharged to the positioning device 42.

In any case, the copy sheets are sequentially stacked such that one side where an image was formed first (first one being the second page from the last) faces upward while the other side where an image was formed later (first one being the last page) faces downward. Specifically, the even pages exist on the lower side of the copy sheets while the odd pages smaller in number than the even pages exist on the upper side. As a result, the copy sheets are accurately stacked in order of page.

The next lowermost document, i.e., the second document or second page of document from the last is fed to the illuminating section and then returned to the document setting portion without being copied. Thereafter, the above procedure is repeated with every other document until the second cycle of document feed completes. At the end of the second cycle, i.e., when non-recirculated documents are absent, one set of copies has been completed. When the number of documents is odd, i.e., when the document fed last is not copied, all the even pages of documents have been copied by the first cycle. Specifically, since the last page whose rear should be left blank is not copied and is absent on the intermediate tray 18, the lowermost document or last page of document fed first during the second cycle is reproduced on a paper sheet fed from the paper feed section.

The above-mentioned lowermost document is returned to the setting portion while the paper sheet carrying the last page is driven out to the discharge unit 3 face up without being routed through the turning device 14. As a result, this paper sheet is discharged to the copy tray 31 or the positioning device of the finisher 4. This two-sided recording method is mainly characterized in that the paper sheet carrying last page and whose rear should be left blank is directly driven out of the copier body and not steered to the intermediate tray 18, as stated above.

Since the second document is an even page and has already been copied, it is simply returned to the setting portion without being copied. The third document is reproduced on the other side of the one-sided copy sheet stacked on the intermediate tray 18 first, i.e., the lowermost copy sheet. For the third document which is one page smaller in number than the rear even page already copied, the two-sided copy sheet is directly discharged without the intermediary of the turning device 14 and with the side thereof copied later facing upward. In this manner, the third and successive documents of odd pages are sequentially illuminated, reproduced on the other side of one-sided copy sheets which are refed from the intermediate tray 18 in the same order as they have been stacked, and driven out of the copier body without being turned over. Then, one set of copies is completed at the end of the second cycle of document feed.

Figure 7B:
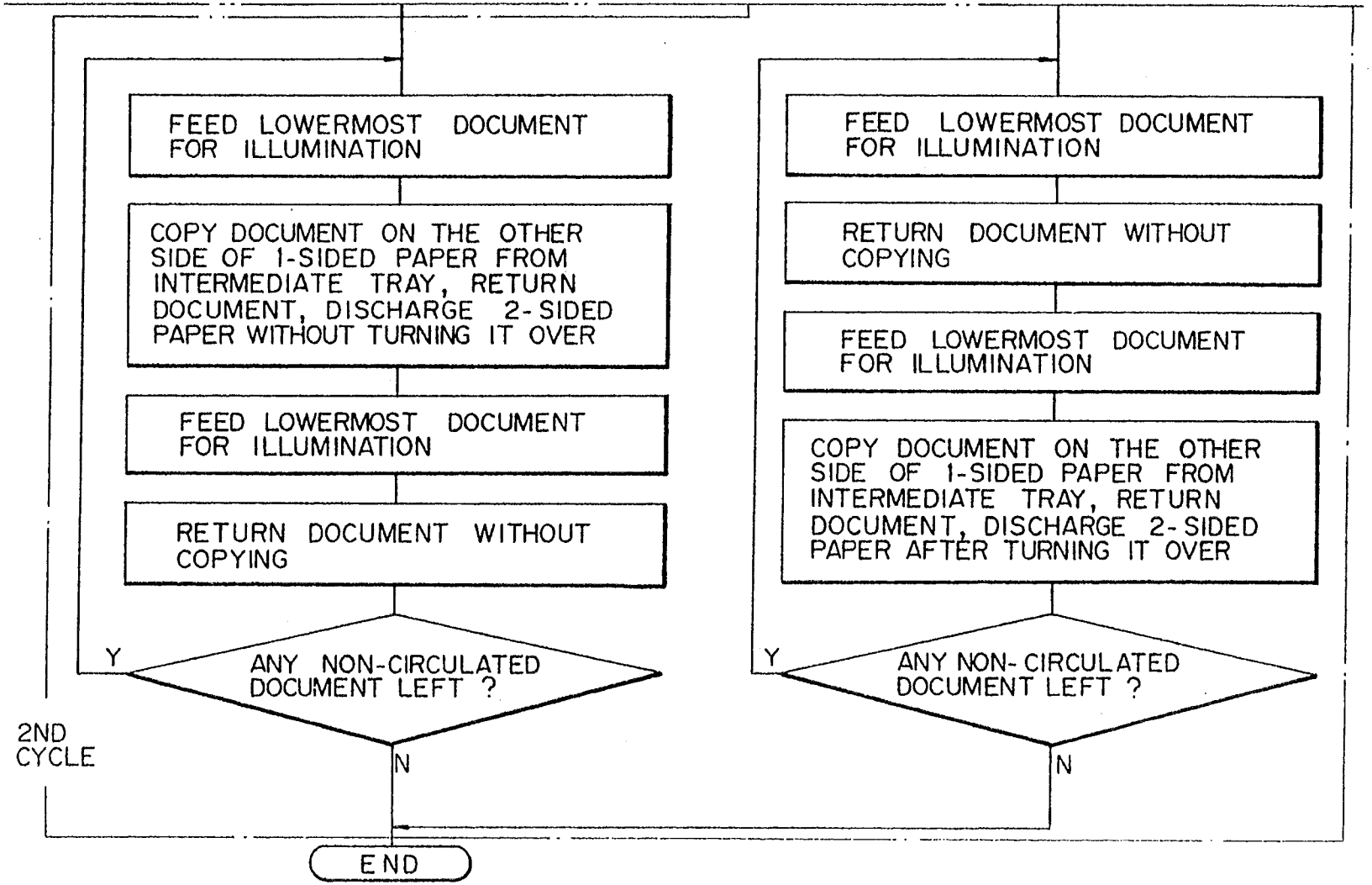

FIG. 7 shows a specific procedure to be executed by the control device 80 of FIG. 5 when the copier of FIG. 3 which forms images on the lower side of paper sheets is operated to produce one set of two-sided copies. In this case, whether or not to turn over copy sheets (via the turning device 14) for stacking them in order of page is determined on a different condition from the above-stated case. Specifically, when images are formed on the upper side of paper sheets, the resulting copy sheets are turned over if even pages are copied after odd pages or not turned over if otherwise, as previously stated. In the specific procedure shown in FIG. 7, the copy sheets are not turned over if even pages are copied after odd pages or are turned over if otherwise. The rest of the procedure is the same as that of FIG. 1 and will not be described specifically.

Figures 8, 8A, 8B, 8C:
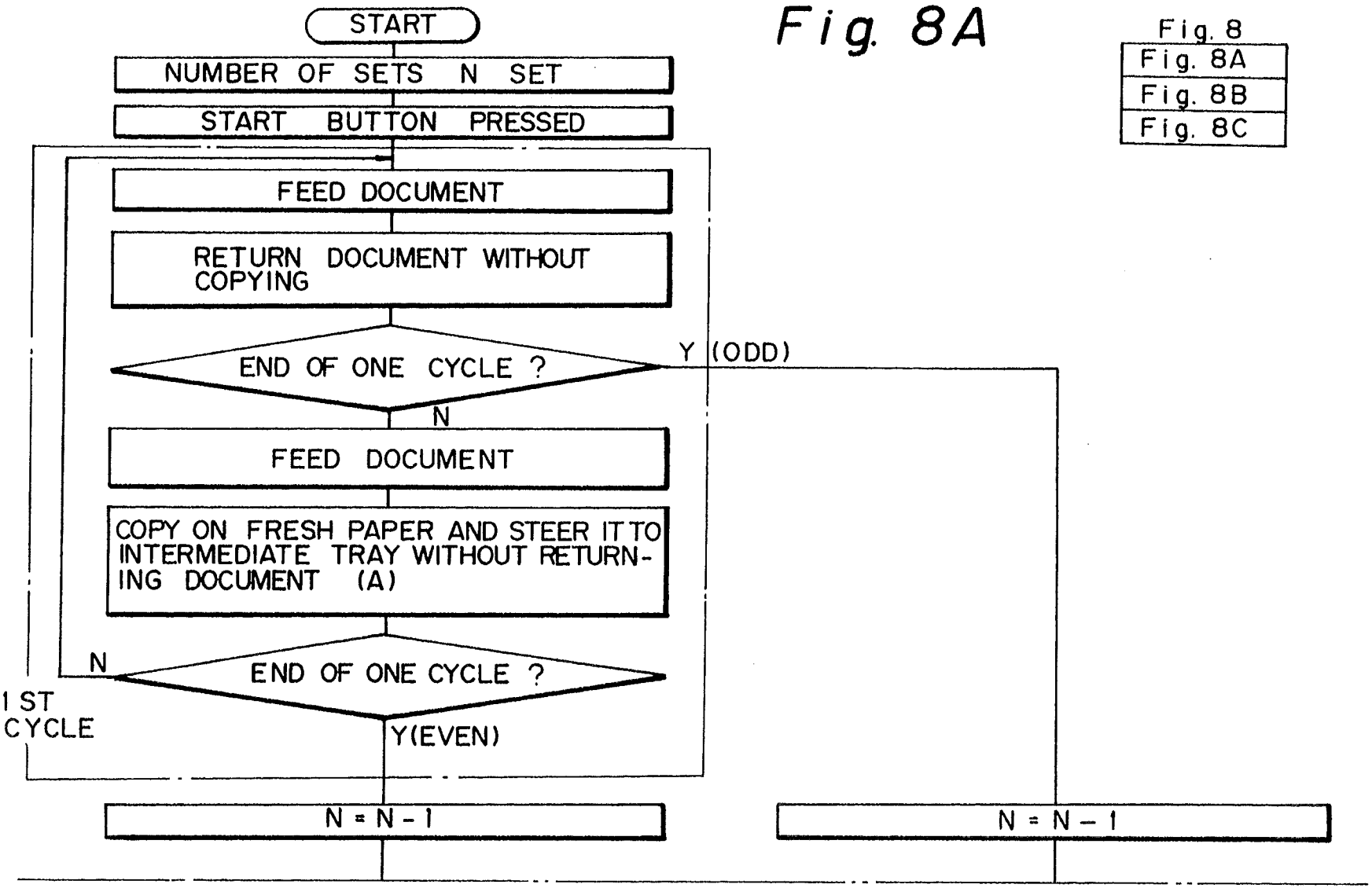
FIGS. 8, 8A, 8B, and 8C are flowcharts representative of an embodiment which produces N sets of two-sided copies of a plurality of one-sided documents by using the copier of FIGS. 2 and 5.
Figure 8B:
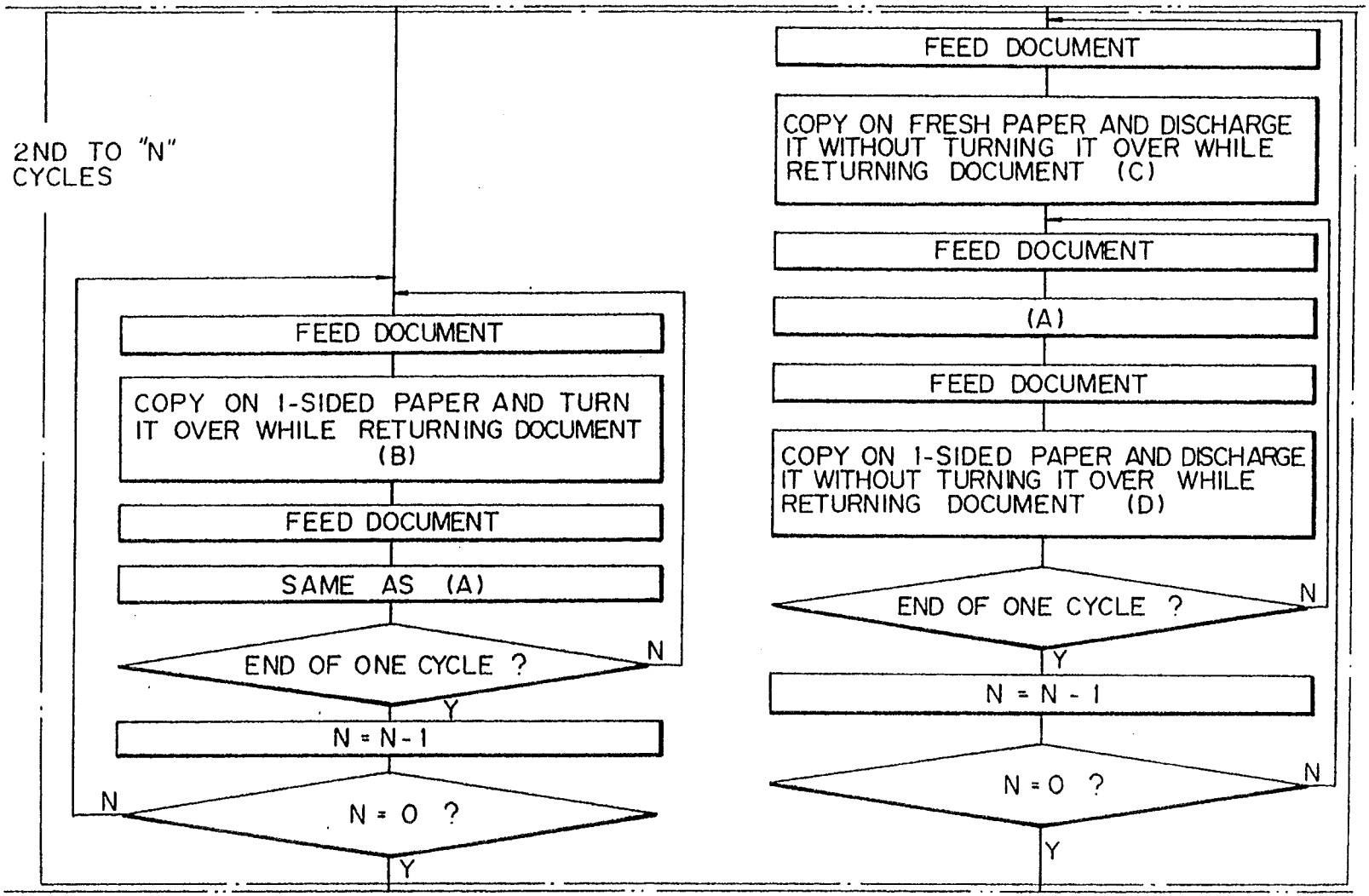
Figure 8C:
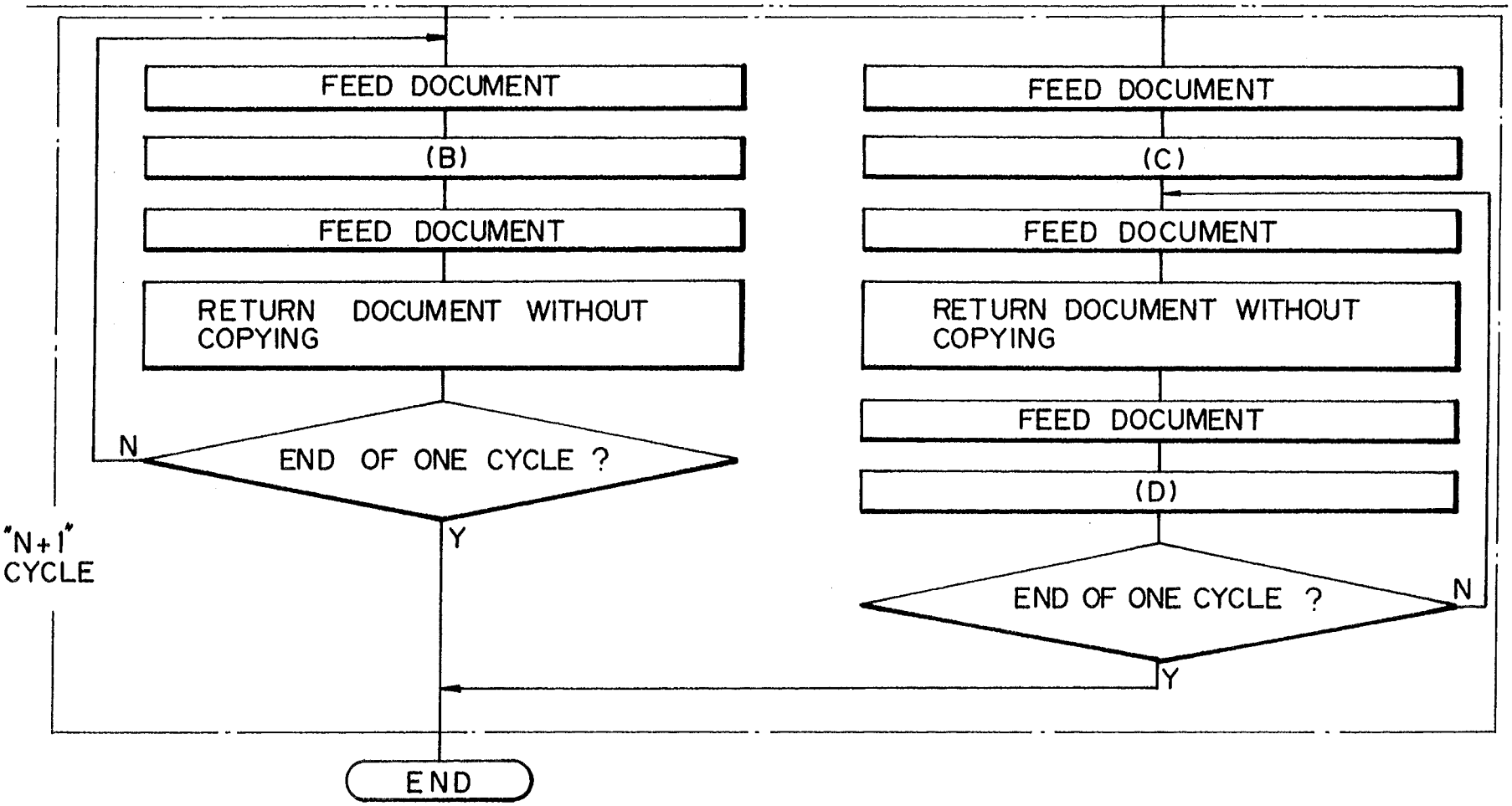
Figures 9, 9A, 9B, 9C:
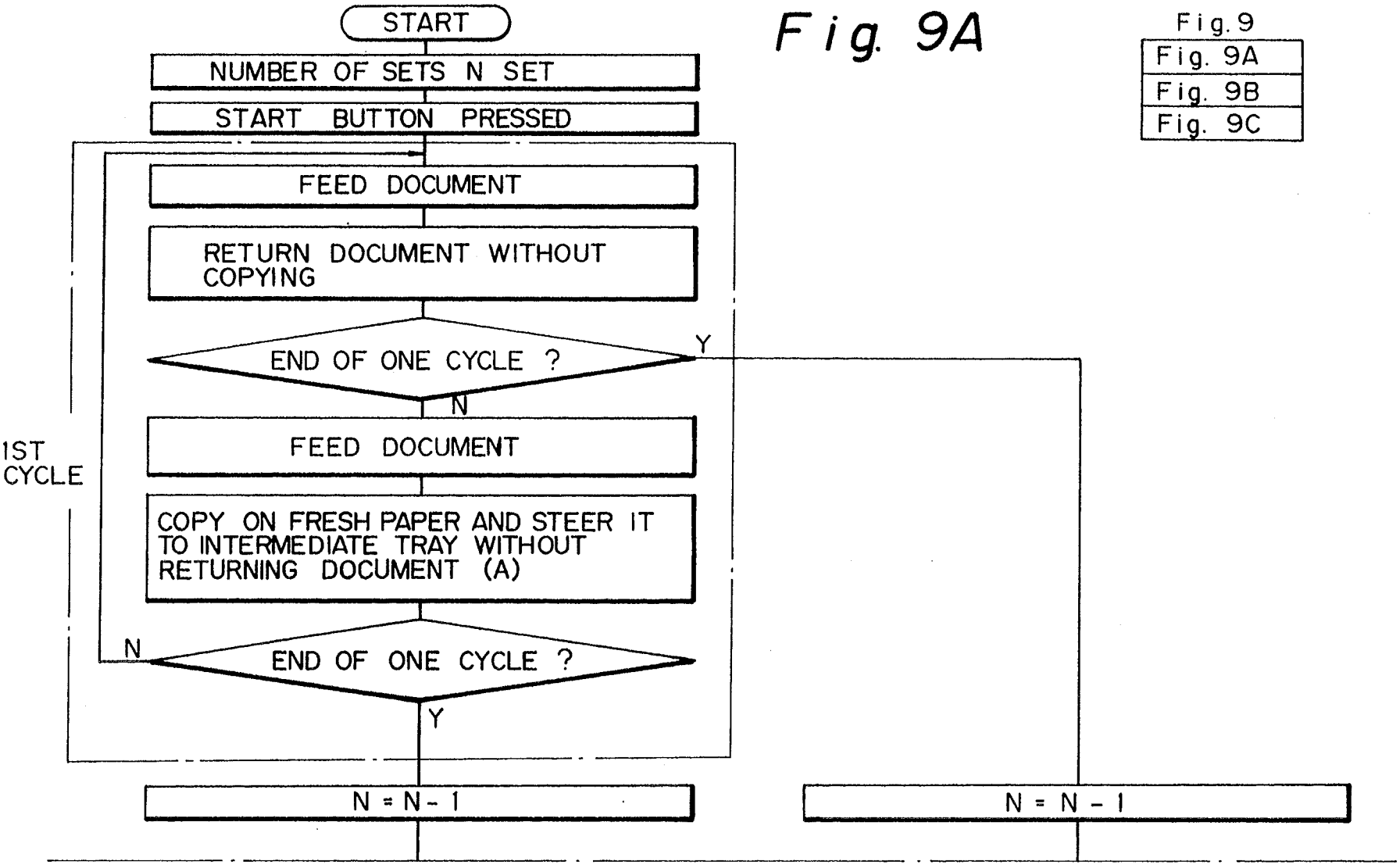
FIGS. 9, 9A, 9B, and 9C are flowcharts representative of an embodiment which produces N sets of two-sided copies of a plurality of one-sided documents by using the copier of FIGS. 3 and 5.
Figure 9B:
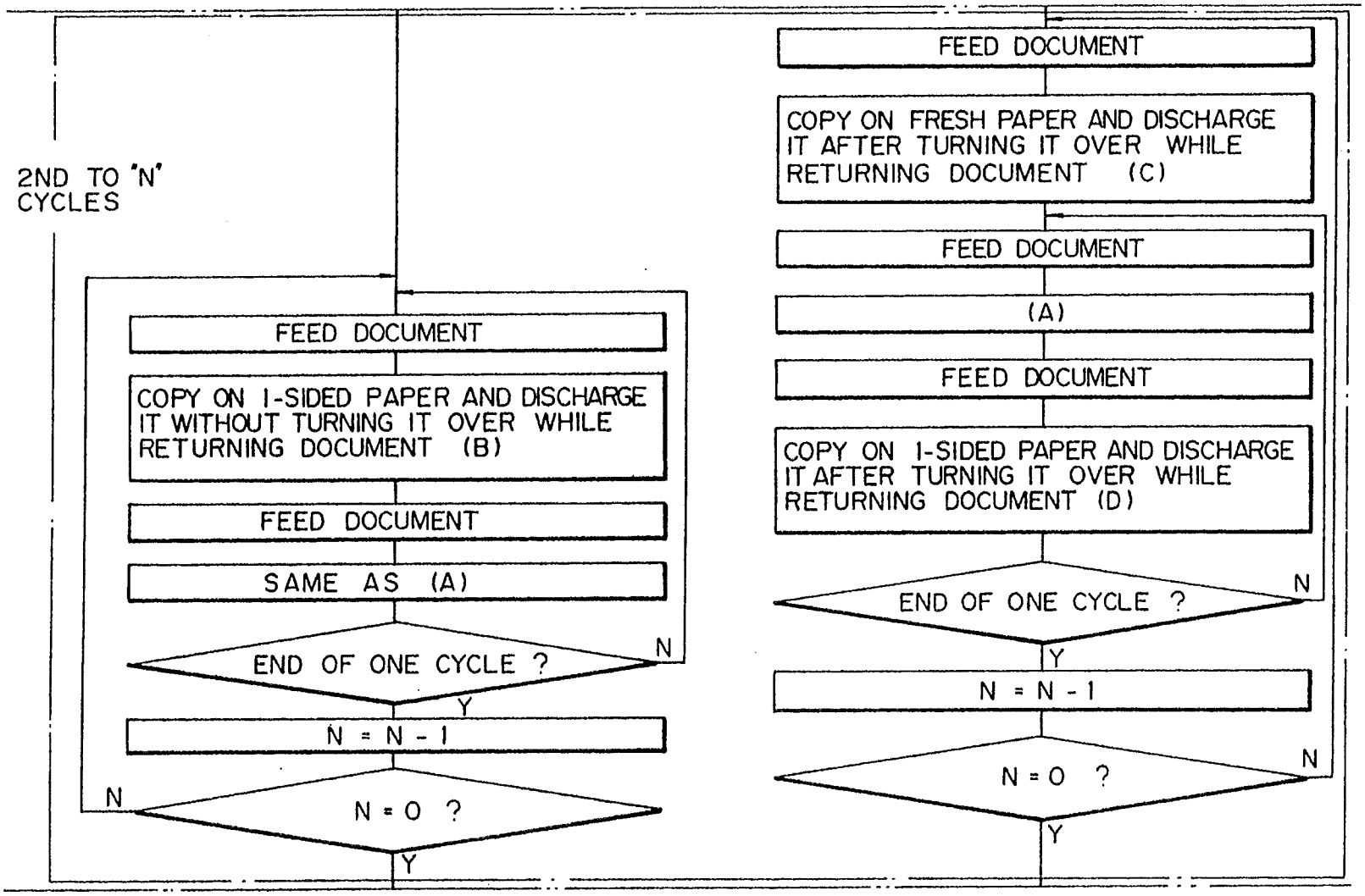
Figure 9C:
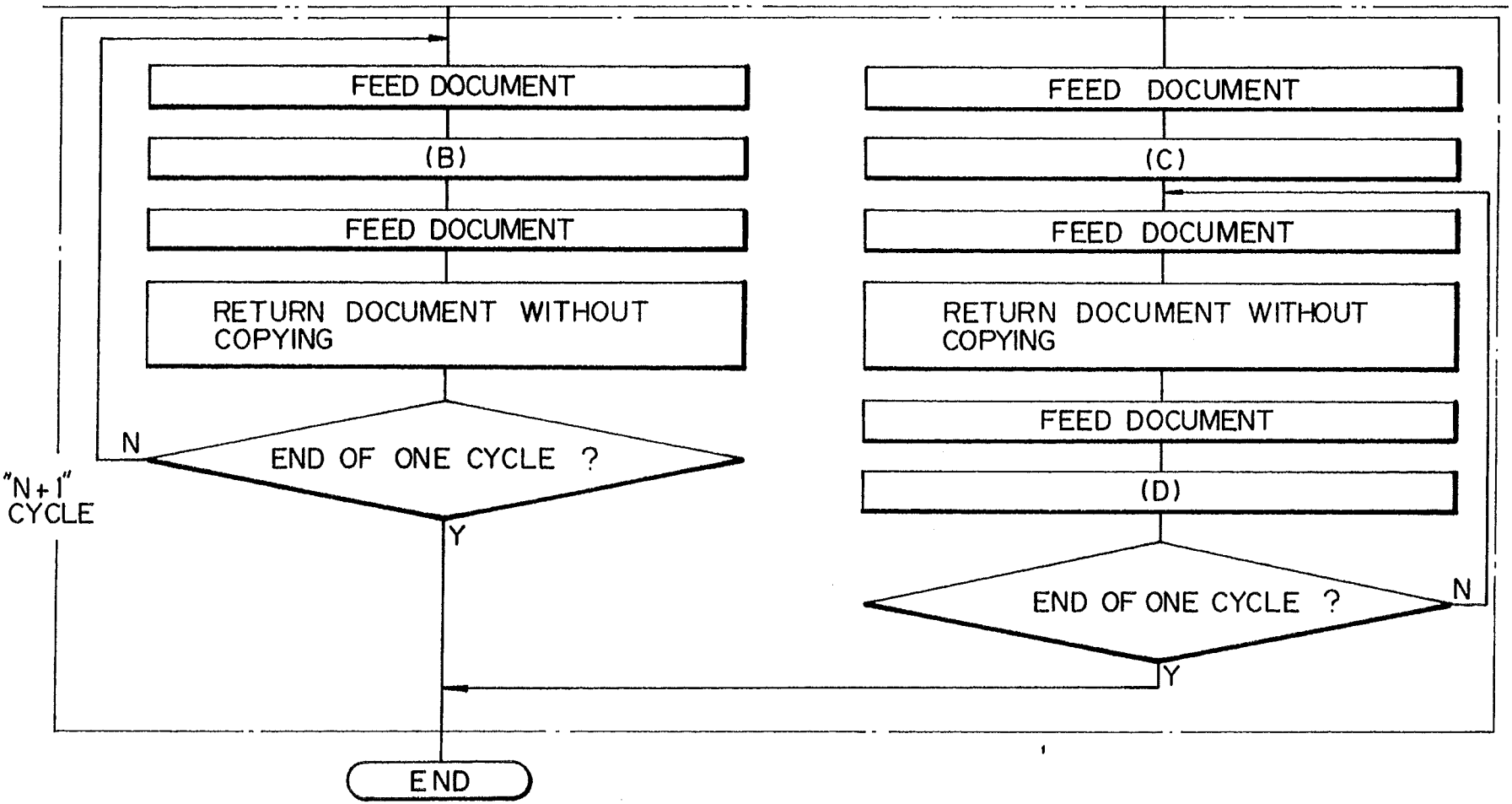

FIGS. 8 and 9 each demonstrates a specific procedure for producing N (2 or greater integer) sets of copies of a plurality of one-sided documents. Since the procedures of FIGS. 8 and 9 are identical except for the side of a paper sheet where an image is to be formed, let the following description concentrate on FIG. 8 wherein the copier of FIG. 2 which forms an image on the upper side of a paper sheet is used. In the flowchart of FIG. 8, various processing and decision steps are represented in simplified form and should be understood to mean the following:

FEED DOCUMENT: Feeding the lowermost document to the illuminating station;

RETURN DOCUMENT WITHOUT COPYING: Returning a document to the setting portion without copying it;

END OF ONE CYCLE?: Whether or not all the documents have been circulated once (in FIG. 1, whether or not non-circulated documents exist; "Y" and "N" are reversed);

COPY ON FRESH PAPER AND STEER IT TO INTERMEDIATE TRAY WHILE RETURNING DOCUMENT (A): Copying the document on a paper sheet fed from the paper feeding device, returning the document to the setting portion, and delivering the resulting copy sheet to the intermediate tray;

COPY ON ONE-SIDED PAPER AND TURN IT OVER WHILE RETURNING DOCUMENT (B): Copying the document on the one-sided copy sheet fed from the intermediate tray, returning the document to the setting portion, and discharging the copy sheet via the turning device (turning it over);

COPY ON FRESH PAPER AND DISCHARGE IT WITHOUT TURNING IT OVER WHILE RETURNING DOCUMENT (C): copying the document on a paper sheet fed from the paper feeding device, returning the document to the setting portion, and discharging the resulting copy sheet without the intermediary of the turning device (without turning it over);

COPY ON ONE-SIDED PAPER AND DISCHARGE IT WITHOUT TURNING IT OVER WHILE RETURNING DOCUMENT (D): copying the document on the one-sided copy sheet refed from the intermediate tray, returning the document to the setting portion. and discharging the resulting copy sheet without the intermediary of the turning device (without turning it over).

As the routine shown in FIG. 8 starts and a desired number N of sets of copies is inputted by the operator, the number N is set in a set counter. When a start button provided on the copier is pressed, a one-side to two-side copy mode operation begins. While the procedure during the first cycle of document feed is identical with the one-set procedure demonstrated in FIG. 1, the set counter is decremented on the completion of first cycle. If the document fed last during the first cycle is copied, meaning that the number of documents is even, all the odd pages of documents have been copied. Then, during the second cycle, the document fed first (even page) is reproduced on the other side of a one-sided copy sheet refed from the intermediate tray. The resulting two-sided copy sheet is turned over and then discharged. This is successful in stacking such copy sheets in order of page. In the previously stated one-set procedure, the second document (odd page) is simply returned without being copied. By contrast, in the procedure of FIG. 8, the second document is reproduced on a paper sheet fed from the paper feeding device, and then the paper sheet is steered to the intermediate tray 18. This implements the same role as during the first cycle for the second set of copies. The discharge to the discharge unit 3 or the ransport to the intermediate tray 18 is selected by the path selector A, FIG. 2.

The above steps executed with the first and second documents are also executed with all the other documents. On the completion of the second cycle, one set of two-sided copies are completed in order of page while one-sided copy sheets of odd pages for the second set are stacked on the intermediate tray 18. Then, the set counter is decremented again ($N=N-1$). As the operation associated with the second cycle is repeated up to the "N" cycle, $N-1$ sets of two-sided copies are produced while one-sided copy sheets of odd pages for the "N" set are stacked on the intermediate tray 18. As the counter is decremented to $N=0$, the program starts on the processing labeled "N+1" CYCLE in FIG. 8, i.e., exactly the same operation as during 2ND CYCLE of the flowchart of FIG. 1. As a result, N sets of two-sided copies are completed.

Assume that the document fed last during the first cycle is not copied, i.e., the number of documents is odd. Then, all the documents of odd pages are copied by the first cycle. Therefore, the document to be fed first during the second cycle is an odd page and the last page requiring a copy sheet whose rear is blank. This document is reproduced on one side of a paper sheet fed from the paper feeding device and is discharged without being turned over since it carries an image on the upper side thereof. The document to be fed next is an even page and, therefore, reproduced on a paper sheet fed from the paper feeding device, and the resulting one-sided copy sheet is transported to the intermediate tray. As a result, the same role as during the first cycle for the second set is achieved. The third document to be fed is an odd page and reproduced on the other side of a one-sided copy sheet of even page. The resulting two-sided copy sheet is discharged without being turned over.

The procedure executed with the second and third documents as stated above is repeated with all the other documents. On the completion of the second cycle, one set of two-sided copies is completed in order of page while one-sided copy sheets of even pages for the second set are stacked on the intermediate tray 18. Then, the set counter is decremented again (N−N−1). The operation described above in relation to the second cycle is repeated up to the "N" cycle. As the steps constituting 2ND CYCLE of FIG. 1 are repeated for the "N+1" cycle, N sets of copies are produced each being arranged in order of page.

Figures 10, 10A:
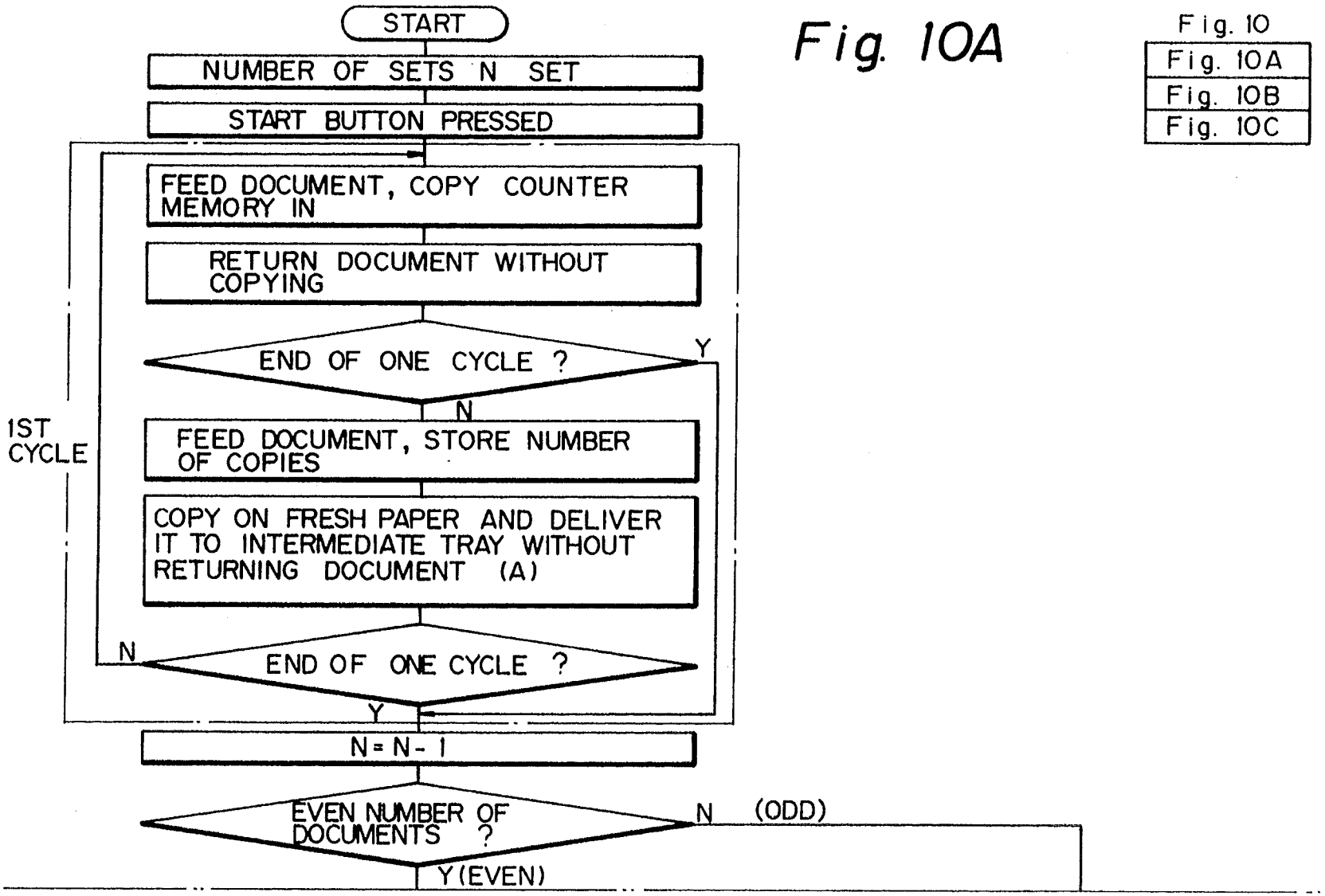
FIGS. 10, 10A, 10B, and 10C are flowcharts representative of an embodiment which produces N sets of two-sided copies of a plurality of one-sided documents by using the copier of FIGS. 2 and 6.
Figure 10B:
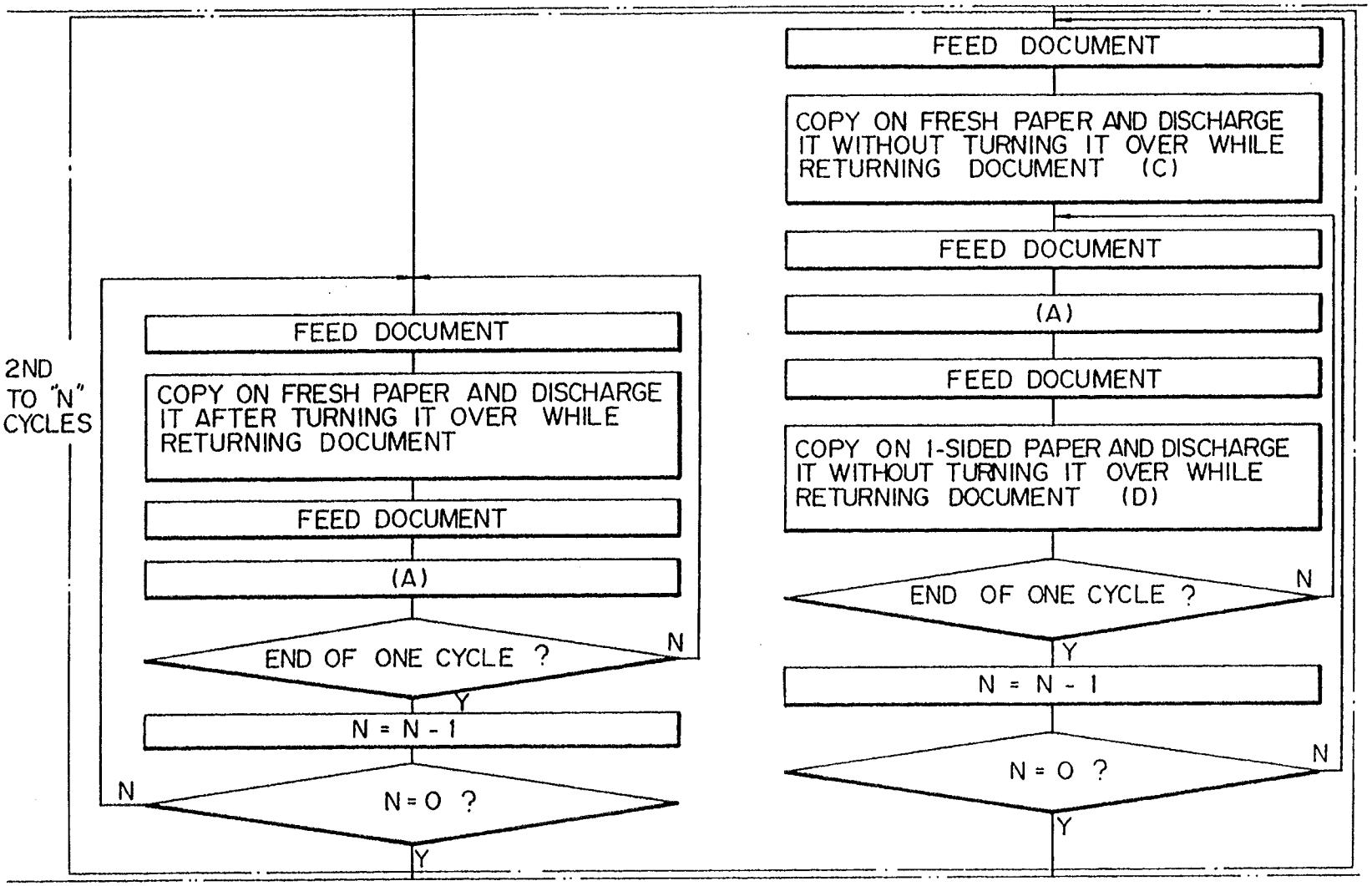
Figure 10C:
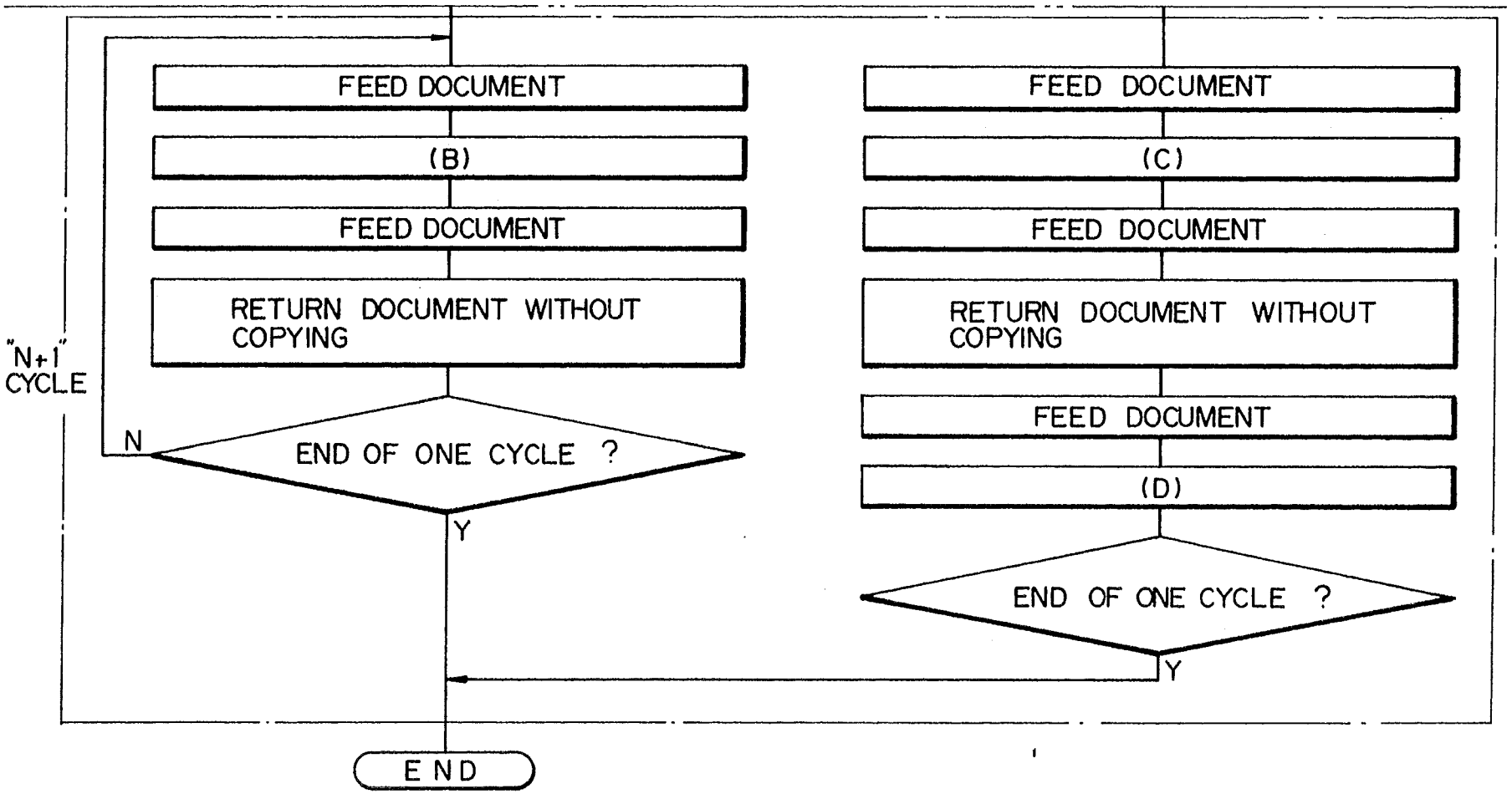

FIG. 10 shows a specific procedure for producing N (2 or greater integer) sets of two-sided copies of a plurality of one-sided documents by use of a copier of the type having the image forming device of FIG. 2 and the RDH 2 of FIG. 6 having the document sensor 30 thereinside. The processing shown in FIG. 10 and associated with the first to "N+1" cycles resembles the processing shown in FIG. 8. In FIG. 10, every time the RDH 2 feeds a document to the illuminating position during the first cycle, a copy counter counts the resulting outputs of the document sensor 30 while a memory stores the count. At the end of the first cycle, whether the number of documents is odd or even is determined on the basis of the count stored in the memory. The rest of the operation will not be described specifically to avoid redundancy. To produce N sets of two-sided copies by use of the image forming device shown in FIG. 3 (including the document sensor 30), it is only necessary to replace the discharge with turn-over and the discharge without turn-over shown in FIG. 10, as in the procedure of FIG. 9.

Figures 11, 11A, 11B, 11C:
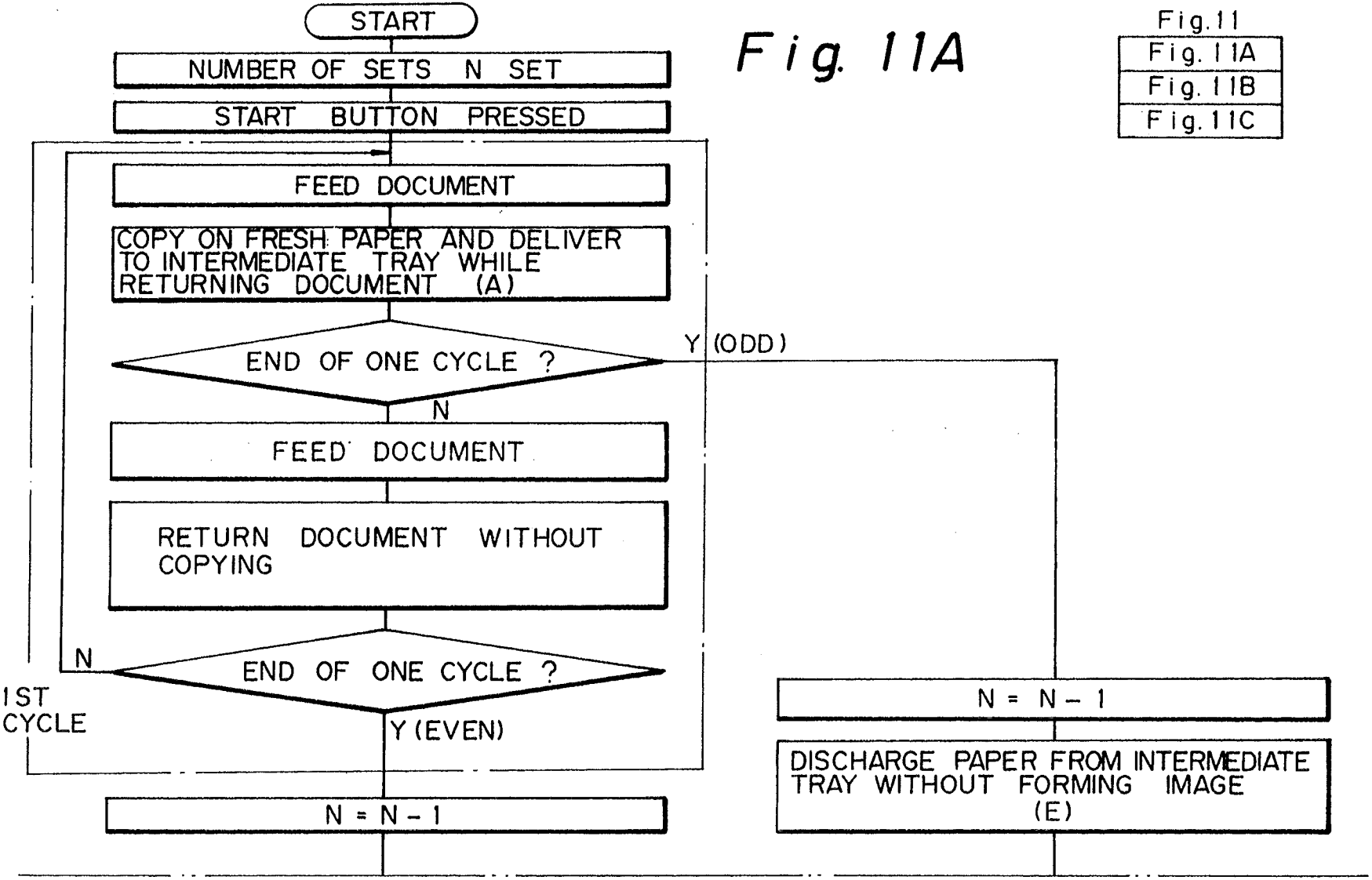
FIGS. 11, 11A, 11B, and 11C are flowcharts representative of an embodiment which produces N sets of two-sided copies of a plurality of one-sided documents by using the copier of FIGS. 2 and 5.
Figure 11B:
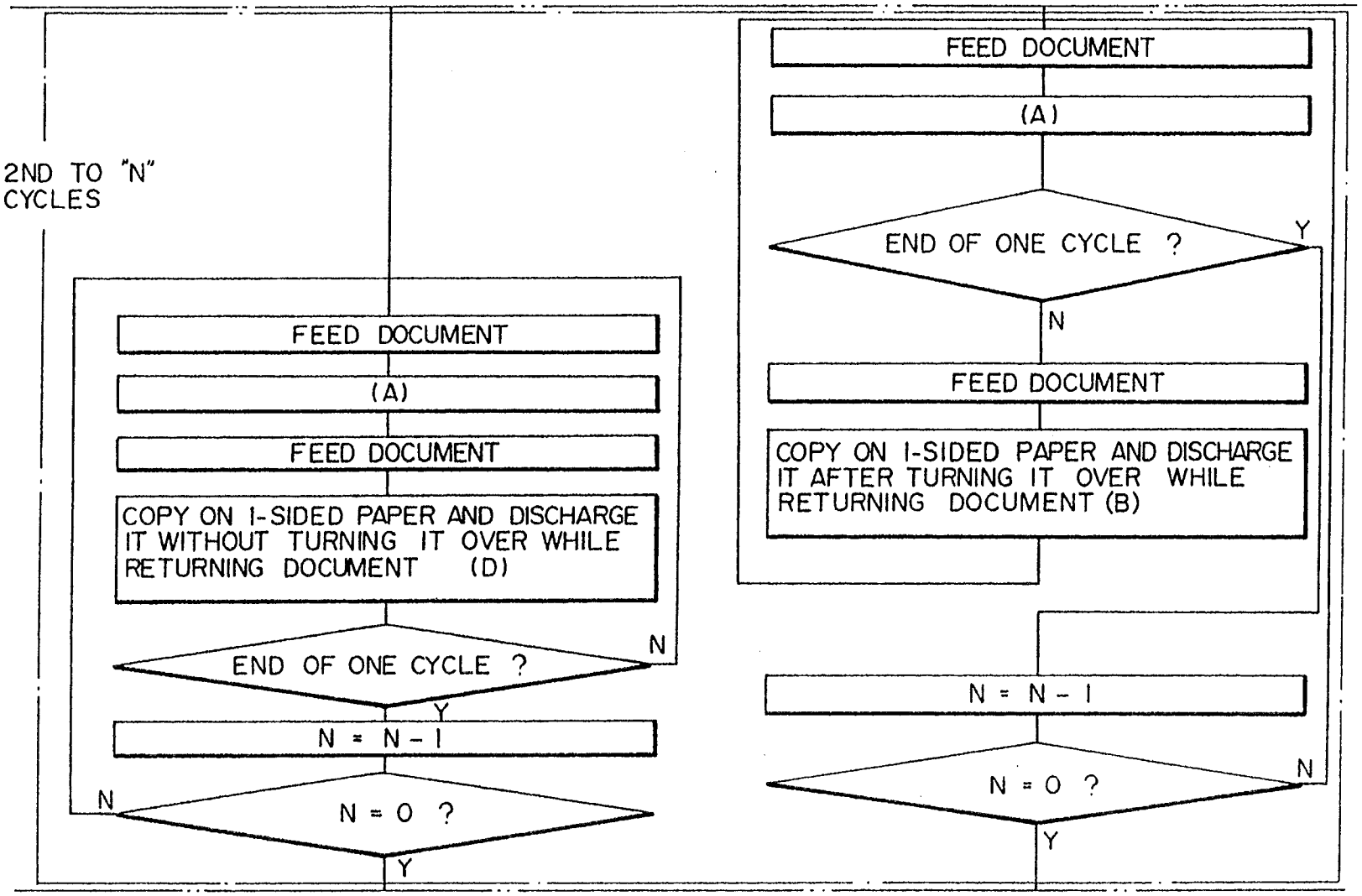
Figure 11C:
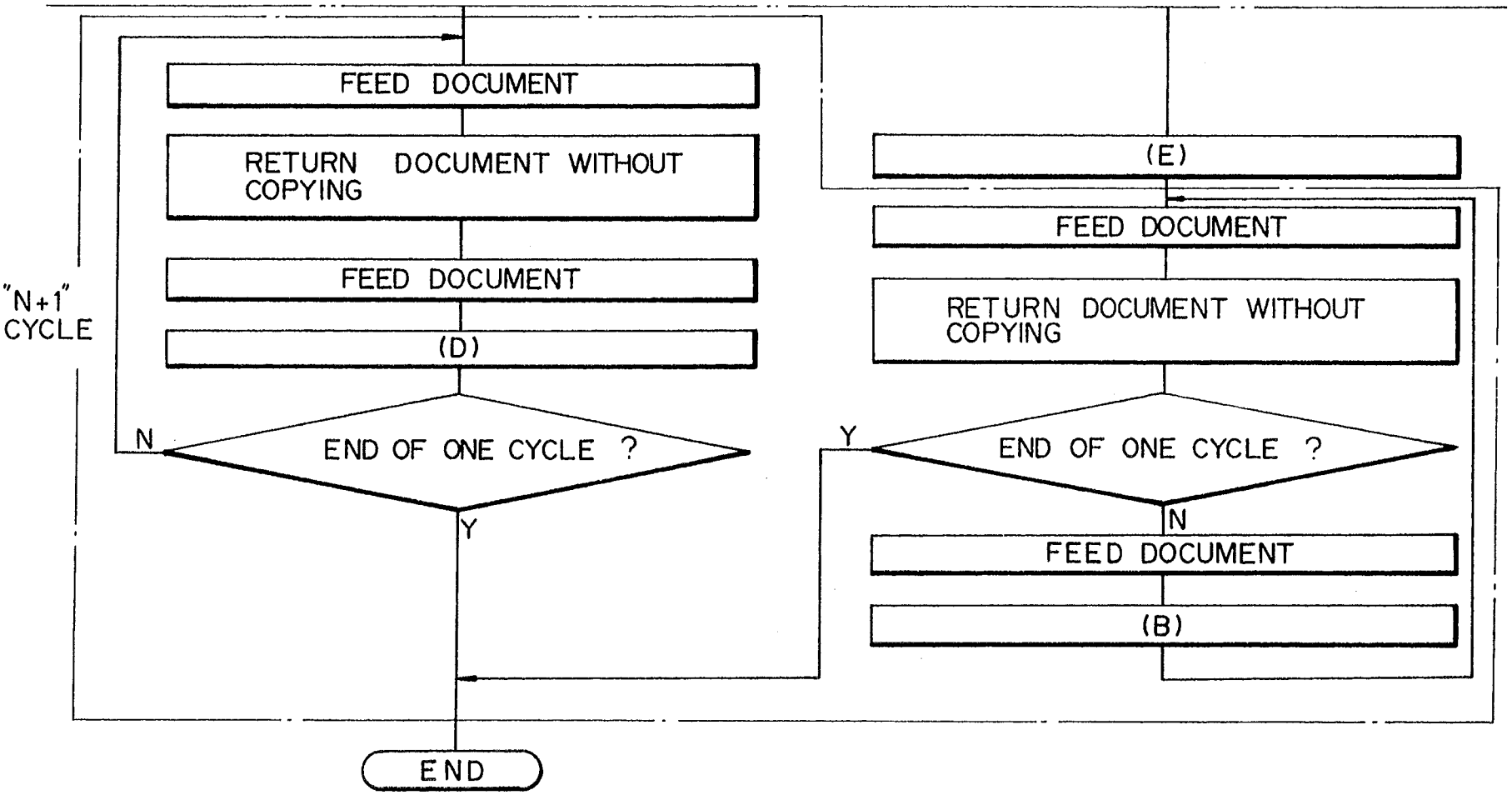

FIG. 11 shows another specific procedure which the copier of FIG. 2 (without the document sensor 30) may execute for producing N sets of two-sided copies of a plurality of one-sided documents, in the same manner as shown in FIG. 8. The procedure of FIG. 11 differs from that of FIG. 8 in that during the first cycle the first document and subsequent every other document are sequentially illuminated and reproduced on paper sheets fed from the paper feeding device and then stacked on the intermediate tray. Therefore, if the document fed last during the first cycle is copied, the number of documents is odd; if otherwise, the number of documents is even.

Specifically, as the routine of FIG. 11 begins and the operator enters the desired number N of sets of copies, the number N is set in the set counter. As the operator presses the start button, the one-sided to two-sided copy mode begins. During the first cycle, the lowermost document (the last page at first) is fed from the setting portion 21 to the illuminating position, illuminated, and then reproduced on a paper sheet fed from the paper feeding device 15. The resulting one-sided copy sheet is delivered to the intermediate tray 18 while the document is returned to the setting portion 21 (A). Then, whether or not the first cycle is completed is determined; if it is not completed, the next document is fed to the illuminating position and then returned to the setting portion 21 without being reproduced. This procedure is repeated with every other document until one cycle completes. If the last copy is not copied as determined on the completion of the first cycle, the number of documents is determined to be even. Then, during the second cycle and successive cycles, the processing shown at the lower left side of FIG. 11 is executed. If the last copy is copied as determined at the end of the first cycle, the number of documents is determined to be odd; the processing shown at the right-hand side of FIG. 11 is executed. In any case, the set counter is decremented (N=N−1).

Assuming that the number of documents is even, i.e., the last page fed first during the first cycle is an even page, then every other document to be reproduced thereafter is also an even page without exception. At the end of one cycle, all the documents of even pages have been reproduced. Therefore, during the second cycle, the document fed first (even page) is reproduced on a paper sheet fed from the paper feeding device 15, and the resulting one-sided copy is delivered to the intermediate tray 18 (A). The second document (odd page) is reproduced on the other side of the lowermost one-sided copy sheet refed from the intermediate tray 18. The resulting two-sided copy sheet is discharged without being turned over. Hence, the lower side of the copy sheet is the last page while the upper side of the same is the second page from the last, i.e., the copy sheets are stacked in order of page.

The above procedure is executed with all the other documents. On the completion of the second cycle, the first set of two-sided copy sheets has been completed in order of page while one-sided copy sheets of even pages for constituting the second set have been stacked on the intermediate tray 18. Then, the set counter is decremented again (N=N−1). When the same procedure as during the second cycle is repeated up to the "N" cycle, N−1 set of two-sided copy sheets are completed while one-sided copy sheets of even pages for constituting the "N" set are stacked on the intermediate tray 18. At this instant, as the set counter is decremented, N becomes zero. This is followed by the processing for the "N+1" cycle. During the "N+1" cycle, the first document is returned without being copied, and the second document is reproduced on the other side of the lowermost one-sided copy sheet refed from the intermediate tray 18 and then discharged without being turned over. As this operation is repeated until one cycle ends, N sets of two-sided copy sheets are completed in order of page.

When the number of documents is odd, the last page to be fed first during the first cycle is an odd page. Hence, every other copy to be reproduced thereafter is also an odd page. It follows that all the documents of odd pages have been copied at the end of one cycle.

Therefore, in this case, the copy sheet of the last page has the rear thereof left blank. For this purpose, before the second cycle, the one-sided copy sheet stacked on the intermediate tray 18 first and carrying the last page is turned over by the turning device 14 and simply discharged without an image formed on the other side thereof (E). As a result, the paper sheet discharged first carries the last page (odd page) on the upper side thereof and has the lower side left blank.

On the start of the second cycle, the first document (odd page) is reproduced on a paper sheet fed from the paper feeding device while the resulting one-sided copy sheet is transported to the intermediate tray 18 (A). The second document (even page) is reproduced on the other side of the lowermost sheet refed from the intermediate tray 18 and carrying the odd page which is third from the last. The resulting two-sided copy sheet is discharged via the turning device (B). Hence, the discharged copy sheet carries an even page on the lower side thereof and an odd page smaller in number than the even page on the upper side, i.e.; the pages are orderly. As such a procedure is repeated until the second cycle completes, one set of two-sided copies are completed in order of page while one-sided copy sheets of odd pages for constituting the second set are stacked on the intermediate tray 18. Then, the set counter is decremented again ($N=N-1$). After the same processing as during the second cycle has been repeated up to the "N" cycle and before the "N+1" cycle begins, the one-sided copy sheet stacked on the intermediate tray 18 first during the previous cycle is discharged via the turning device 14 without an image formed on the other side thereof (E). At the "N+1" cycle, the first document is returned without being copied, and the second document is copied on the other side of the lowermost one-sided copy sheet refed from the intermediate tray 18; the resulting two-sided copy sheet is turned over and then discharge (B). As such a procedure is repeated until one cycle completes, N sets of two-sided copy sheets are completed in order of page.

The procedure of FIG. 11 is not as efficient as the others since, when the number of documents is odd, the lowermost one-sided sheet has to be refed from the intermediate tray 18 before each of the second and successive cycles begins. However, such a procedure is far advantageous over the conventional two-sided copy procedure since it is practicable without resorting to special implementations for determining whether the number of documents is odd or even, e.g., the document sensor, counter, and memory.

To produce N sets of two-sided copy sheets by use of the copier of the type shown in FIG. 3, the procedure shown in FIG. 11 may also be adopted only if the discharge with turn-over and the discharge without turn-over are replaced with each other.

The embodiments described above have various unprecedented advantages, as enumerated below.

(1) Even when an odd number of one-side documents are reproduced on both sides of paper sheets, the first page of a set of copies or the rear thereof is prevented from being left blank. The operator is free from troublesome operations preceding the start of copying, e.g., counting documents and inputting the "number of documents" and "odd/even" information and, when the number of documents is odd, adding an extra blank document to the documents to make the number even. Troubles due to the miscount of documents are eliminated. Since it is not necessary for the RDH to wastefully circulate documents once before the start of copying for counting documents, there are eliminated various undesirable occurrences including the decrease in copying efficiency due to the waste of time, document jams, smears, scratches, and the acceleration of the wear of RDH constituent parts. Since the circulation of documents begins with the last page, not only the circulation path of the RDH is simple, but also the document transport speed does not have to be excessively high. This reduces the cost and enhances reliable document transport.

(2) At the first cycle, the document fed first (last page) is not copied with no regard to the number of documents, i.e., odd or even. Then, when the number of documents is odd, a copy sheet associated with the document of the last page and whose rear has to be left blank is prevented from entering the intermediate tray. This eliminates, smears, scratches, jams, and the wear of constituent parts ascribable to such a copy sheet. Moreover, the above-mentioned copy sheet does not have to be discharged between the first and second cycles, i.e., the second cycle can be started immediately. Specifically, during the second cycle, the first document is reproduced on a paper sheet fed from the paper feeding device, and the resulting copy sheet is directly discharged. Hence, the exclusive period of time for the discharge of such a copy sheet is not necessary, whereby an extremely efficient two-side copier is achievable.

(3) Whether the number of documents is odd or even is determined by copying every other document during the first cycle and determining whether or not the last document has been copied (or is to be copied) at the end of the first cycle. This is successful in eliminating the need for a document sensor, counter, and memory and, therefore, in simplifying the construction and reducing the cost.

(4) A set of two-sided copies arranged in order of page is achievable only if, whether the copier be of the type forming an image on the upper side of a paper sheet or of the type forming it on the lower side of a paper sheet, the operation of the turning device is reversed at the time of copy discharge.

(5) Assume N sets of two-sided copies of one-sided documents are desired, and that the number of documents is odd. Then, during the second to the "N" cycles, the first document is reproduced on a paper sheet fed from the paper feeding section while the resulting one-sided copy sheet is discharged, the second document is reproduced on a paper sheet from the paper feeding section while the resulting copy sheet is transported to the intermediate tray, and the third document is reproduced on a copy sheet refed from the intermediate tray while the resulting two-sided copy sheet is discharged. The procedure executed with the second and third documents is repeated with the other documents. Therefore, even a great sets of copies can be produced with considerable efficiency. This promotes efficient finishing with a stapler or finisher connected to the recording device.

(6) The sensor 29 constituting the end-of-feed detecting device together with the separating member 27 senses the feed of the last document. If whether the number of documents is odd or even is determined on the basis of whether or not the last document has been copied, the above-described functions (1)–(5) can be implemented with a simple construction.

Various modifications will become possible for those skilled in the art after receiving the teachings of the present disclosure without departing from the scope thereof.

What is claimed is:

1. A method of recording a plurality of documents arranged in an initial order including at least a first document, a second document, and a third document, each of said plurality of documents carrying an image on one side thereof, to both sides of paper sheets in correct order by using a two-side recording apparatus comprising an image forming device for forming an image of a document on a paper sheet, a paper feeding device for feeding paper sheets to an image forming region of the image forming device one by one, an intermediate tray for temporarily stacking one-sided paper sheets carrying an image on one side thereof, a refeeding device for sequentially refeeding the one-sided paper sheets stacked on the intermediate tray to the image forming region such that an image is formed on the other side of each of said one-sided paper sheets, a discharging device for discharging the paper sheets, a turning device for turning over the paper sheets before said paper sheets are discharged, an illuminating section for illuminating documents for exposure, a recirculating document handler (RDH), having a first cycle and a second cycle, for sequentially feeding a stack of documents to the illuminating section in reverse order and returning said documents to said stack so that said documents are arranged in the initial order, and a control device for controlling operations of said recording apparatus;

said method comprising the steps of:

illuminating, during the first cycle of documents fed by the RDH, the second document and every other successive document;

feeding the paper sheets from the paper feeding device to the image forming region to thereby reproduce said second document and every other successive document on one side of said paper sheets;

stacking the one-sided paper sheets on the intermediate tray;

illuminating, during the second cycle, the first document and every other successive document, sequentially refeeding the one-sided paper sheets to the image forming region to reproduce said first document and every other successive document on the other side of said one-sided paper sheets, and discharging the paper sheets with or without the intermediary of the turning device such that the side of each of said paper sheets formed first faces upward when the last of said plurality of documents is illuminated during the first cycle; and illuminating the first document during the second cycle, feeding a paper sheet from the paper feeding device to the image forming region to reproduce said first document on one side of said paper sheet, illuminating the third document and every other successive document, sequentially refeeding the one-sided paper sheets from the intermediate tray to the image forming region to reproduce said third document and every other successive document on the other side of said one-sided paper sheets, and discharging all the paper sheets with or without the intermediary of the turning device such that the side all the paper sheets formed first faces upward when the last of said plurality of documents is not illuminated during the first cycle.

2. A method of recording a plurality of documents arranged in an initial order having at least a first document, a second document, and a last document, each of said plurality of documents carrying an image on one side thereof, to both sides of paper sheets in correct order by using a two-side recording apparatus comprising an image forming device for forming an image of a document on a paper sheet, a paper feeding device for feeding paper sheets to an image forming region of the image forming device one by one, an intermediate tray for temporarily stacking one-sided paper sheets carrying an image on one side thereof, a refeeding device for sequentially refeeding the one-sided paper sheets stacked on the intermediate tray to the image forming region such that an image is formed on the other side of each of said one-sided paper sheets, a discharging device for discharging the paper sheets, a turning device for turning over the paper sheets before said paper sheets are discharged, an illuminating section for illuminating documents for exposure, a recirculating document handler (RDH), having a plurality of cycles "N" including at least a first cycle, a second cycle, an "N" cycle, and an "N+1" cycle, for sequentially feeding a stack of documents to the illuminating section in reverse order and returning said documents to said stack so that said documents are arranged in the initial order, and a control device for controlling operations of said devices;

said method comprising the steps of:

illuminating, during the first cycle of documents fed by the RDH, the second document and every other successive document;

feeding the paper sheets from the paper feeding device to the image forming region to thereby reproduce said second document and every other successive document on one side of said paper sheets;

stacking the one-sided paper sheets on the intermediate tray;

illuminating all the documents during each cycle from the second cycle to the "N" cycle, sequentially refeeding the one-sided paper sheets from the intermediate tray to the image forming region to reproduce the first document and every other successive document on the other side of said one-sided paper sheets, and discharging the resulting two-sided paper sheets with or without the intermediary of the turning device such that the side of said paper sheets formed first faces upward when the last document is illuminated during the first cycle;

feeding paper sheets from the paper feeding device to the image forming region to reproduce the second document and every other successive document on one side of said paper sheets;

stacking the resulting one-sided paper sheets on the intermediate tray;

illuminating, during the "N+1" cycle of the RDH, the first document and every other successive document, sequentially refeeding the one-sided paper sheets from said intermediate tray to reproduce said first document and every other successive document on the other side of said one-sided paper sheets, and discharging resulting two-sided paper sheets with or without the intermediary of the turning device such that the side of said two-sided paper sheets formed first faces upward;

illuminating all the documents during the second cycle to the "N" cycle, feeding a paper sheet from the paper feeding device to the image forming region to reproduce the first document on one side of said paper sheet, and discharging the resulting one-sided paper sheet with or without the intermediary of the turning device such that the imaged side faces upward when the last document is not illuminated during the first cycle;

feeding paper sheets from the paper feeding device to the image forming region to reproduce the second document and every other successive document on one side of said paper sheets, stacking resulting one-sided paper sheets on the intermediate tray, refeeding one-sided paper sheets stacked on said intermediate tray during a previous cycle to said image forming region to reproduce the third document and every other successive document on the other side of said one-sided paper sheets, and discharging all the paper sheets with or without the intermediary of the turning device such that the side of said paper sheets formed later faces upward; and illuminating the first document during the "N+1" cycle of the RDH, feeding a paper sheet from the paper feeding device to the image forming region to reproduce said first document on one side of said paper sheet, illuminating the third document and every other successive document, sequentially refeeding one-sided paper sheets stacked on the intermediate tray during a previous cycle to said image forming region to reproduce said third document and every other successive document on the other side of said one-sided documents, and discharging all the paper sheets with or without the intermediary of the turning device such that the side of said paper sheets formed later faces upward.

3. A method of recording a plurality of documents arranged in an initial order including at least a first document and a second document, each of said plurality of documents carrying an image on one side thereof, to both sides of paper sheets in correct order by using a two-side recording apparatus comprising an image forming device for forming an image of a document on a paper sheet, a paper feeding device for feeding paper sheets to an image forming region of the image forming device one by one, an intermediate tray for temporarily stacking one-sided paper sheets carrying an image on one side thereof, a refeeding device for sequentially refeeding the one-sided paper sheets stacked on the intermediate tray to the image forming region such that an image is formed on the other side of each of said one-sided paper sheets, a discharging device for discharging the paper sheets, a turning device for turning over the paper sheets before said paper sheets are discharged, a first guide member for selectively guiding a paper sheet toward the discharging device or toward the intermediate tray, a second guide member for selectively guiding a paper sheet to a path including the turning device or to a path not including said turning device, an illuminating section for illuminating documents for exposure, an RDH, having a plurality of cycles including a first cycle and a last cycle, for sequentially feeding a stack of documents to the illuminating section in reverse order and returning said documents to said stack so that said documents are arranged in the initial order, a separating member for separating unfed documents from documents having been returned by the RDH within a single stack, an end-of-feed detecting device for determining that the unfed documents positioned at one side of the separating member have been fully fed, a document sensor located on a document recirculation path for sensing passage of a document, and a control device for controlling operations of said recording apparatus;

said method comprising the steps of:

subjecting, during the first cycle of the RDH, only the second document and every other successive document to image formation to reproduce said second document and every other successive document on one side of paper sheets fed from the paper feeding device to the image forming region, stacking the one-sided paper sheets on the intermediate tray by guiding said one-sided paper sheets via the first guide member, and counting a number of documents which have passed the document sensor;

determining, after the end-of-feed detecting device has determined that all the documents have been fed for the first cycle, whether the number of documents counted is odd or even;

subjecting, if the number of documents is even, only the first document and every other successive document to image formation during the last cycle to reproduce said first document and every other successive document on the other side of one-sided paper sheets refed from the intermediate tray in the same order as the paper sheets have been stacked, and sequentially discharging the resulting two-sided paper sheets such that the side of said two-sided paper sheets formed first faces upward by controlling the second guide member;

subjecting, if the number of documents is odd, the first document to image formation during the last cycle to reproduce said first document on one side of a paper sheet fed from the paper feeding device to the image forming region;

sequentially subjecting, among the second and successive documents, only the third document and every other successive document to image formation to reproduce said third document and every other successive document on the other side of the one-sided paper sheets refed from the intermediate tray in the same order as said paper sheets have been stacked, and controlling all of the resulting two-sided paper sheets such that the side of said two-sided paper sheets formed first later faces upward by controlling the second guide member.

4. A method of recording a plurality of documents, each of said plurality of documents arranged in an initial order including at least at least a first document and a second document, carrying an image on one side thereof, to both sides of paper sheets in correct order by using a two-side recording apparatus comprising an image forming device for forming an image of a document on a paper sheet, a paper feeding device for feeding paper sheets to an image forming region of the image forming device one by one, an intermediate tray for temporarily stacking one-sided paper sheets carrying an image on one side thereof, a refeeding device for sequentially refeeding the one-sided paper sheets stacked on the intermediate tray to the image forming region such that an image is formed on the other side of each of said one-sided paper sheets, a discharging device for discharging the paper sheets, a turning device for turning over the paper sheets before said paper sheets are discharged, a first guide member for selectively guiding a paper sheet toward the discharging device or toward the intermediate tray, a second guide member for selectively guiding a paper sheet to a path including the turning device or to a path not including said turning device, an illuminating section for illuminating documents for exposure, an RDH, having at least a first cycle and a last cycle, for sequentially feeding a stack of documents to the illuminating section in reverse order and returning said documents to said stack so that said documents are arranged in the initial order, a separating member for separating unfed documents from documents having been returned by the RDH within a single stack, an end-of-feed detecting device for determining that the unfed documents positioned at one side of the separating member have been fully fed, and a control device for controlling operations of said recording apparatus;

said method comprising the steps of:

subjecting, during the first cycle of RDH, only the first document and every other successive document to image formation to reproduce said first document and every other successive document on one side of paper sheets fed from the paper feeding device to the image forming region, and stacking the one-sided paper sheets on the intermediate tray via the first guide member;

determining, when the end-of-feed detecting device determines that the last document has been fed during the first cycle, whether or not said last document has been subjected to image formation;

subjecting, if the last document has not been subjected to image formation, the second document and every other successive document to image formation during the last cycle to reproduce said second document and successive every other document on the other side of the one-sided paper sheets refed from the intermediate tray in the same order as said paper sheets have been stacked, and discharging the resulting two-sided paper sheets such that the side of said two-sided paper sheets formed later faces upward by controlling the second guide member; and if the last document has not been subjected to image formation, starting, before the last cycle, refeeding of the one-sided paper sheet stacked on the intermediate tray without image formation and such that the imaged side of said paper sheet faces upward by controlling the second guide member, subjecting, during the last cycle, only the second document and every other successive document to image formation to reproduce said second document and every other successive document on the other side of the one-sided paper sheets refed from the intermediate tray in the same order as said paper sheets have been stacked, and discharging the two-sided paper sheets such that the side of said paper sheets formed first faces upward by controlling the second guide member.

5. A two-side recording apparatus comprising:

an image forming device for forming an image of a document on a paper sheet;

a paper feeding device for feeding paper sheets to an image forming region of said image forming device one by one;

an intermediate tray for temporarily stacking one-sided paper sheets carrying an image on one side thereof;

a refeeding device for sequentially refeeding the one-sided paper sheets stacked on said intermediate tray to the image forming region such that an image is formed on the other side of each of said one-sided paper sheets;

a discharging device for discharging the paper sheets;

a turning device for turning over the paper sheets before said paper sheets are discharged;

a first guide member for selectively guiding a paper sheet toward said discharging device or toward said intermediate tray;

a second guide member for selectively guiding a paper sheet to a path including said turning device or to a path not including said turning device;

an illuminating section for illuminating documents for exposure;

an RDH, having a first cycle and a last cycle, for sequentially feeding a stack of documents arranged in an initial order, in reverse order to said illuminating section and returning said documents to said stack so that said documents are arranged in the initial order;

a separating member for separating unfed documents from documents having been returned by the RDH within a single stack;

an end-of-feed detecting device for determining that the unfed documents positioned at one side of said separating member have been fully fed; and a control device for controlling operations of said recording apparatus;

said control device comprising;

(a) means for subjecting, during the first cycle of said RDH for circulating a plurality of documents, including at least a first document, a second document, and a third document, carrying an image on one side thereof, only the second document and every other successive document to reproduce said second document and every other successive document on one side of paper sheets fed from said paper feeding device to the image forming region, and sequentially stacking the one-sided paper sheets on said intermediate tray by guiding said paper sheets with said first guide member;

(b) determining means for determining, when said end-of-feed detecting device determines that the last document has been fed during the first cycle, whether or not said last document has been subjected to image formation; and (c) means for subjecting only the first document and every other successive document to image formation during the last cycle to sequentially reproduce said first document and every other successive document on the other side of one-sided paper sheets refed in the same order as said paper sheets have been stacked and discharging the resulting two-sided paper sheets such that the side of said two-sided paper sheets formed first faces upward by actuating said second guide member if the last document has not been subjected to image formation; and subjecting the first document and only the third document and every other successive document among the second and successive documents to image formation during the last cycle to thereby sequentially reproduce said first document on one side of a paper sheet fed from said paper feeding device and said third document and every other successive document on the other side of one-sided paper sheets refed from said intermediate tray in the same order as said paper sheets have been stacked and discharging all the paper sheets such that the side of said paper sheets formed later faces upward by actuating said second guide member if the last document has not been subjected to image formation.

* * * * *